US009865196B2

(12) United States Patent
Lin et al.

(10) Patent No.: US 9,865,196 B2
(45) **Date of Patent: *Jan. 9, 2018**

(54) DISPLAY PANEL OF COMBINING GATE CONTROL SIGNAL AND EMITTING CONTROL SIGNAL

(71) Applicant: AU OPTRONICS CORP., Hsinchu (TW)

(72) Inventors: Ya-Ting Lin, Hsin-Chu (TW); Yu-Sheng Huang, Hsin-Chu (TW)

(73) Assignee: AU OPTRONICS CORP., Hsinchu (TW)

( * ) Notice: Subject to any disclaimer, the term of this patent is extended or adjusted under 35 U.S.C. 154(b) by 292 days.

This patent is subject to a terminal disclaimer.

(21) Appl. No.: 14/625,920

(22) Filed: Feb. 19, 2015

(65) Prior Publication Data

US 2016/0055829 A1 Feb. 25, 2016

(30) Foreign Application Priority Data

Aug. 22, 2014 (TW) ..... 103129056

(51) Int. Cl.
*G09G 3/36* (2006.01)
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0814* (2013.01); *G09G 2300/0852* (2013.01); *G09G 2300/0861* (2013.01); *G09G 2310/0262* (2013.01); *G09G 2310/0281* (2013.01); *G09G 2310/0283* (2013.01); *G09G 2310/0286* (2013.01); *G09G 2310/0289* (2013.01); *G09G 2310/08* (2013.01)

(58) Field of Classification Search
CPC ..... G09G 3/32–3/3291; G09G 2310/0262
See application file for complete search history.

(56) References Cited

U.S. PATENT DOCUMENTS

2007/0240024 A1 10/2007 Shin
2007/0262929 A1* 11/2007 Kim ..... G09G 3/006 345/76
2008/0001889 A1* 1/2008 Chun ..... G09G 3/2011 345/96

(Continued)

FOREIGN PATENT DOCUMENTS

CN 101471033 A 7/2009
TW 200820199 5/2008

*Primary Examiner* — Yuzhen Shen
(74) *Attorney, Agent, or Firm* — WPAT, PC

(57) ABSTRACT

A display panel includes a display area first and second gate line driving circuits. The display area includes a plurality of pixels is configured to determine how to process a data transmitted on a data line according to first and second control signals transmitted on first and second gate lines respectively and a second control signal transmitted on a second gate line and determine when to emit light according to a light emitting control signal transmitted on a light emitting control line. The first gate line driving circuit is coupled to the first gate line and for providing the first control signal thereto. The second gate line driving circuit is coupled to the second gate line and the light emitting control line and configured to provide the second control signal and the light emitting control signal thereto, respectively.

17 Claims, 19 Drawing Sheets

(56) References Cited

U.S. PATENT DOCUMENTS

| | | | | |
|---|---|---|---|---|
| 2008/0100544 | A1 | 5/2008 | Wu | |
| 2008/0246697 | A1* | 10/2008 | Kim | G09G 3/006 345/76 |
| 2008/0297449 | A1* | 12/2008 | Yamashita | G09G 3/3233 345/76 |
| 2009/0046041 | A1* | 2/2009 | Tanikame | G09G 3/3233 345/76 |
| 2009/0115707 | A1* | 5/2009 | Park | G09G 3/3233 345/76 |
| 2009/0167743 | A1 | 7/2009 | Goh et al. | |
| 2009/0303169 | A1* | 12/2009 | Tanikame | G09G 3/3266 345/100 |
| 2011/0041020 | A1* | 2/2011 | Liu | G01B 31/31853 714/731 |
| 2011/0316833 | A1* | 12/2011 | Chang | G09G 3/3677 345/211 |
| 2014/0140468 | A1 | 5/2014 | Cheng et al. | |
| 2014/0285108 | A1* | 9/2014 | Kim | G11C 19/184 315/291 |
| 2015/0002558 | A1* | 1/2015 | Kumeta | G09G 3/3233 345/690 |
| 2015/0364083 | A1* | 12/2015 | Jeon | G09G 3/3233 345/76 |
| 2015/0371584 | A1* | 12/2015 | Lin | G11C 19/28 345/214 |

* cited by examiner

500

DISPLAY PANEL OF COMBINING GATE CONTROL SIGNAL AND EMITTING CONTROL SIGNAL

TECHNICAL FIELD

The present disclosure relates to a display panel, and more particularly to a driving circuit of a display panel.

BACKGROUND

Flat panel display is a display apparatus for displaying images based on pixel circuits; and for displaying images normally, various types of pixel circuits may need to be adopted with various types of driving circuit designs.

Referring to FIG. 1, which is a circuit view of a conventional pixel circuit used in a flat panel display. As shown, the pixel circuit 10 is configured to, while being supplied with operations voltage levels OVDD, VIN and OVSS, determine when to receive display data DATA and determine when to control a light emitting diode D1 to emit light by controlling P-type transistors T1, T2, T3, T4, T5 and T6 and two capacitors Cst1 and Cst2 through gate control signals Scan_N, Scan_N−1 and a light emitting control signal EM. For example, as shown in FIG. 1, the transistor T1 is configured to have its control terminal only electrically coupled to the gate control signal Scan_N−1; it first terminal only connected to the first terminal of the capacitors $C_{st1}$, the second terminal of the capacitors $C_{st2}$, the first terminal of the transistor T3 and the control terminal of the transistor T4; and its second terminal only electrically coupled to the operation voltage level VIN. The transistor T2 is configured to have its control terminal only connected to the light emitting control signal EM and the control terminal of the transistor T5; it first terminal only connected to the second terminal of the capacitors $C_{st1}$ and the operation voltage level OVDD; and its second terminal only connected to the first terminal of the transistor T4 and the first terminal of the transistor T6. The transistor T3 is configured to have its control terminal only connected to the first terminal of the capacitors $C_{st2}$, the control terminal of the transistor T6 and the gate control signal Scan_N; and it second terminal only connected to the second terminal of the transistor T4 and the first terminal of the transistor T5. The transistor T5 is configured to have its second terminal only connected to the first terminal of the light emitting diode D1. The light emitting diode D1 is configured to have its second terminal only connected to the operation voltage level OVSS. The transistor T6 is configured to have its second terminal only connected to the display data DATA. In response to the pixel circuit 10 of FIG. 1, currently a driving circuit of FIG. 2 is employed.

Referring to FIG. 2, which is a circuit block view of a conventional driving circuit used in a flat panel display. As shown, the flat panel display 20 includes a display area 200, in which a plurality of pixel circuits as illustrated in FIG. 1 are disposed. Each pixel circuit is controlled by the gate control signals Scan_N, Scan_N−1 and the light emitting control signal EM. In order to clarify the relationship between the control signals and the pixel circuits, the gate control signals supplied to the pixel circuit in the first row are provided by the first gate control signal generation unit Scan_P(1) and the second gate control signal generation unit Scan_P−1(1), respectively; and the light emitting control signal supplied to the pixel circuit in the first row is provided by the light emitting control signal generation unit EMP(1). Therefore, when the display area 200 has 960 rows of pixel circuit, accordingly there must exist 960 first gate control signal generation units Scan_P(1), Scan_P(2), . . . , Scan_P(959) and Scan_P(960), 960 second gate control signal generation units Scan_P−1(1), Scan_P−1(2), . . . , Scan_P−1(959) and Scan_P−1(960), and 960 light emitting control signal generating units EMP(1), EMP(2), . . . , EMP(959) and the EMP(960).

In a conventional driving circuit as shown in FIG. 2, the first gate control signal generation units Scan_P(1)~Scan_P(960) and the second gate control signal generation units Scan_P−1(1)~Scan_P−1(960) are disposed on the same side of the display area 200, and the light emitting control signal generating units EMP(1)~EMP(960) are disposed on another side of the display area 200. Each one of the first gate control signal generation units Scan_P(1)~Scan_P(960) and each one of the second gate control signal generation units Scan_P−1(1)~Scan_P−1(960) are controlled by one of the shift registers RSR(1)~RSR(960). For example, a pair of the first gate control signal generation unit Scan_P(1) and the second gate control signal generation unit Scan_P−1(1) are only controlled by the shift registers RSR(1); . . . ; and a pair of the first gate control signal generation unit Scan_P(960) and the second gate control signal generation unit Scan_P−1(960) are only controlled by the shift registers RSR(960). Similarly, each one of the light emitting control signal generation units EMP(1)~EMP(960) is controlled by one of the shift registers LSR(1)~LSR(960). For example, the light emitting control signal generation unit EMP(1) is only controlled by the shift register LSR(1); . . . ; and the light emitting control signal generation unit EMP(960) is only controlled by the shift register LSR(960). It is to be noted that the shift registers LSR(1)~LSR(960) and the shift registers RSR(1)~RSR(960) are different elements or different groups. In addition, to facilitate a less complicate design for clock signals, the driving circuit may further be disposed with dummy shift registers RBDSR, LUDSR and LBDSR. Specifically, the dummy shift register RBDSR is only connected to the last shift register RSR(960); the dummy shift register LUDSR is only connected to the first shift register LSR(1); and the dummy shift register LBDSR is only connected to the last shift register LSR(960).

Through the driving circuit of FIG. 2, the display panel 20 can display images normally. However, when the pixel circuits 10 of FIG. 1 are configured to display images through a driving of the driving circuit of FIG. 2, the gate control signals Scan_N, Scan_N−1 may have mismatch impedance issue, which may lead to a poor luminous uniformity on the display panel 20. In addition, conventionally, the shift registers, the first gate control signal generation unit and the second gate control signal generation unit may need a lot of transistors for an implementation; thus, once these transistors have electrical drifts caused by manufacturing process errors, these shift registers may not have normal functions and consequentially may result in display deterioration. In addition, because the driving circuit may need more ten control signals, the circuit design of the signal source configured to provide these control signals may be complicated.

SUMMARY

The present disclosure discloses a display panel, which includes a display area a first gate line driving circuit and a second gate line driving circuit. The display area includes a plurality of pixels. Each one of the plurality of pixels is configured to determine how to process a data transmitted on a data line according to a first control signal transmitted on a first gate line and a second control signal transmitted on a second gate line and determine when to emit a light according to a light emitting control signal transmitted on a light emitting control line. The first gate line driving circuit is disposed in a first area outside the display area. The first gate line driving circuit is electrically coupled to the first gate line and configured to provide the first control signal to the first gate line. The second gate line driving circuit is disposed in a second area outside the display area. The second gate line driving circuit is electrically coupled to the second gate line and configured to provide the second control signal to the second gate line. The second gate line driving circuit is further electrically coupled to the light emitting control line and configured to provide the light emitting control signal to the light emitting control line. The first area and the second area are located on different sides of the display area. A minimum time interval, between a first enable period of the first control signal and a second enable period of the second control signal used in a first pixel, is equal to a time length of the first enable period

BRIEF DESCRIPTION OF THE DRAWINGS

The present disclosure will become more readily apparent to those ordinarily skilled in the art after reviewing the following detailed description and accompanying drawings, in which.

DETAILED DESCRIPTION OF PREFERRED EMBODIMENTS

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Figure 3:
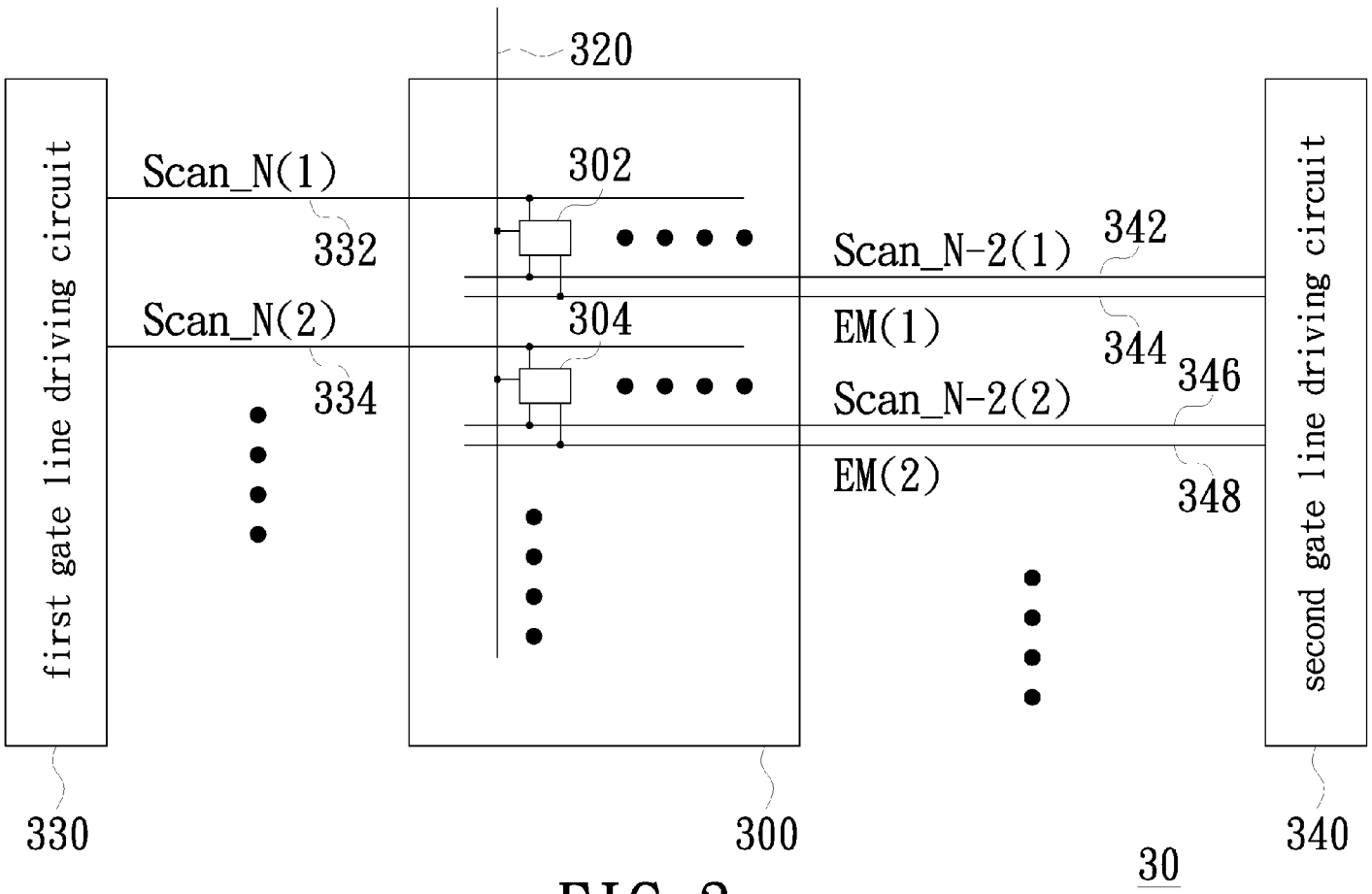
FIG. 3 is a circuit block view of a flat panel display in accordance with an embodiment of the present disclosure.

FIG. 3 is a circuit block view of a flat panel display in accordance with an embodiment of the present disclosure. As shown, the flat panel display 30 in the present embodiment includes a display area 300, a first gate line driving circuit 330, a second gate line driving circuit 340, a data line 320, first gate lines 332, 334, second gate lines 342, 346, and light emitting control lines 344, 348. In addition, the display area 300 includes a plurality of pixels 302, 304, each which is affected by the respective first gate line, the respective second gate lines and the respective light emitting control line. For example, the pixel 302 is electrically coupled to the first gate line 332, the second gate line 342, the light emitting control line 344 and the data lines 320 and is configured to determine how to process the data transmitted on the data line 320 according to the control signal Scan_N(1) transmitted on the first gate line 332 (hereafter the control signal Scan_N is referred to as the first control signal) and the control signal Scan_N−2(1) transmitted on the second gate line 342 (hereafter the control signal Scan_N−2 is referred to as the second control signal) and determine when to emit light according to the light emitting control signal EM(1) transmitted on the light emitting control line 344. Similarly, the pixel 304 is electrically coupled to the first gate line 334, the second gate line 346, the light emitting control line 348 and the data lines 320 and is configured to determine how to process the data transmitted on the data line 320 according to the first control signal Scan_N(2) transmitted on the first gate line 334 and the second control signal Scan_N−2(2) transmitted on the second gate line 346 and determine when to emit light according to the light emitting control signal EM(2) transmitted on the light emitting control line 348.

Figure 1:
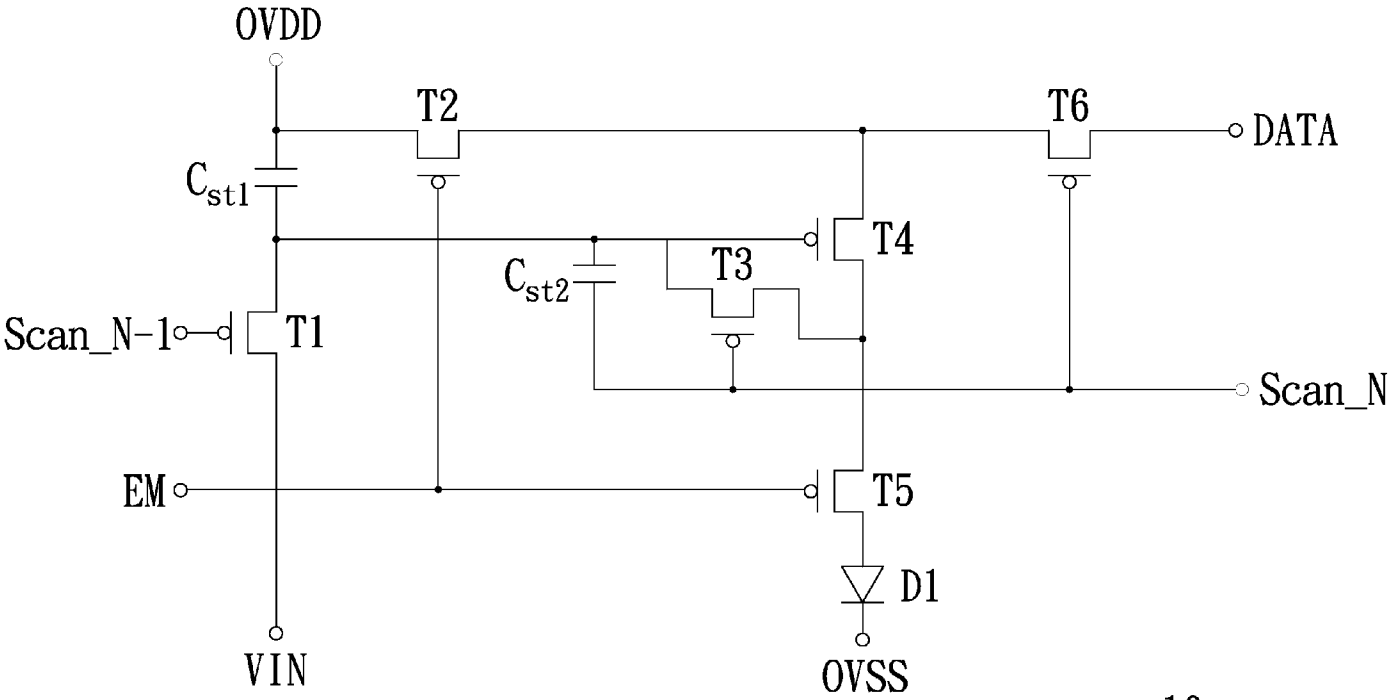
FIG. 1 (prior art)
FIG. 1 is a is a circuit view of a conventional pixel circuit used in a flat panel display.
Figure 2:
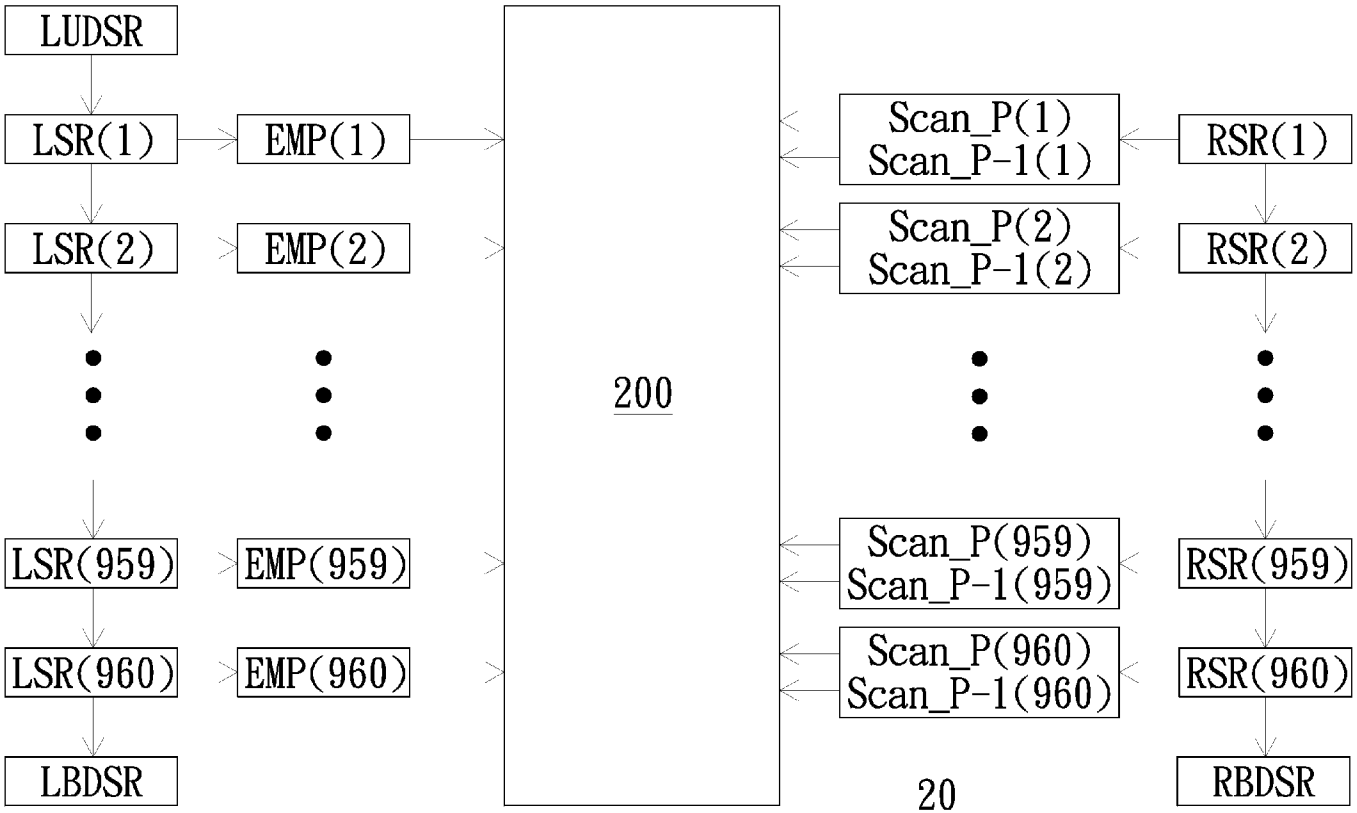
FIG. 2(prior art)
FIG. 2 is a circuit block view of a conventional driving circuit used in a flat panel display.

The pixels 302, 304 may have circuit structures same as the pixel circuit 10 of FIG. 1. However, it is to be noted that the control signal Scan_N−1 in FIG. 1 is instead of the second control signal Scan_N−2. In addition, it is understood that the pixels 302, 304 may have another circuit design; however, this another circuit design still needs to use the first control signal Scan_N and the second Scan_N−2 as the control signals for the corporation of the control signals provided in the present embodiment.

As shown in FIG. 3, the first gate line driving circuit 330 is disposed on the left external side of the display area 300, and the second gate line driving circuit 340 is disposed on the right external side of the display area 300. The first gate line driving circuit 330 is electrically coupled to the first gate lines 332, 334 and is configured to provide the first control signals Scan_N(1), Scan_N(2) to the first gate lines 332, 334, respectively. Besides being electrically coupled to the second gate lines 342, 346, the second gate line driving circuit 340 is further electrically coupled to the light emitting control lines 344, 348 and is configured to provide the second control signals Scan_N−2(1), Scan_N−2(2) to the second gate lines 342, 346 and provide the light emitting control signals EM(1), EM(2) to the light emitting control lines 344, 348, respectively.

Through the above circuit design, the signals with relatively large driving impedance differences are separated to two groups. To facilitate a better understanding of the present disclosure, herein the first control signal Scan_N, the light emitting control signal EM, and the second control signal Scan_N−2 are took as an example for driving the pixel circuit 10 shown in FIG. 1. Because the first control signal Scan_N is responsible for reading data and compensating the threshold voltage, the impedance load (RC Loading) of the being-driven first control signal Scan_N is much larger than that of the being-driven second control signal Scan_N−2 and the being-driven light emitting control signal EM. Thus, in the present embodiment, the first control signal Scan_N is designed to be generated by the first gate line driving circuit 330 independently; and the second control signal Scan_N−2 and the light emitting control signal EM are designed to be generated by the second gate line driving circuit 340.

Figure 4:
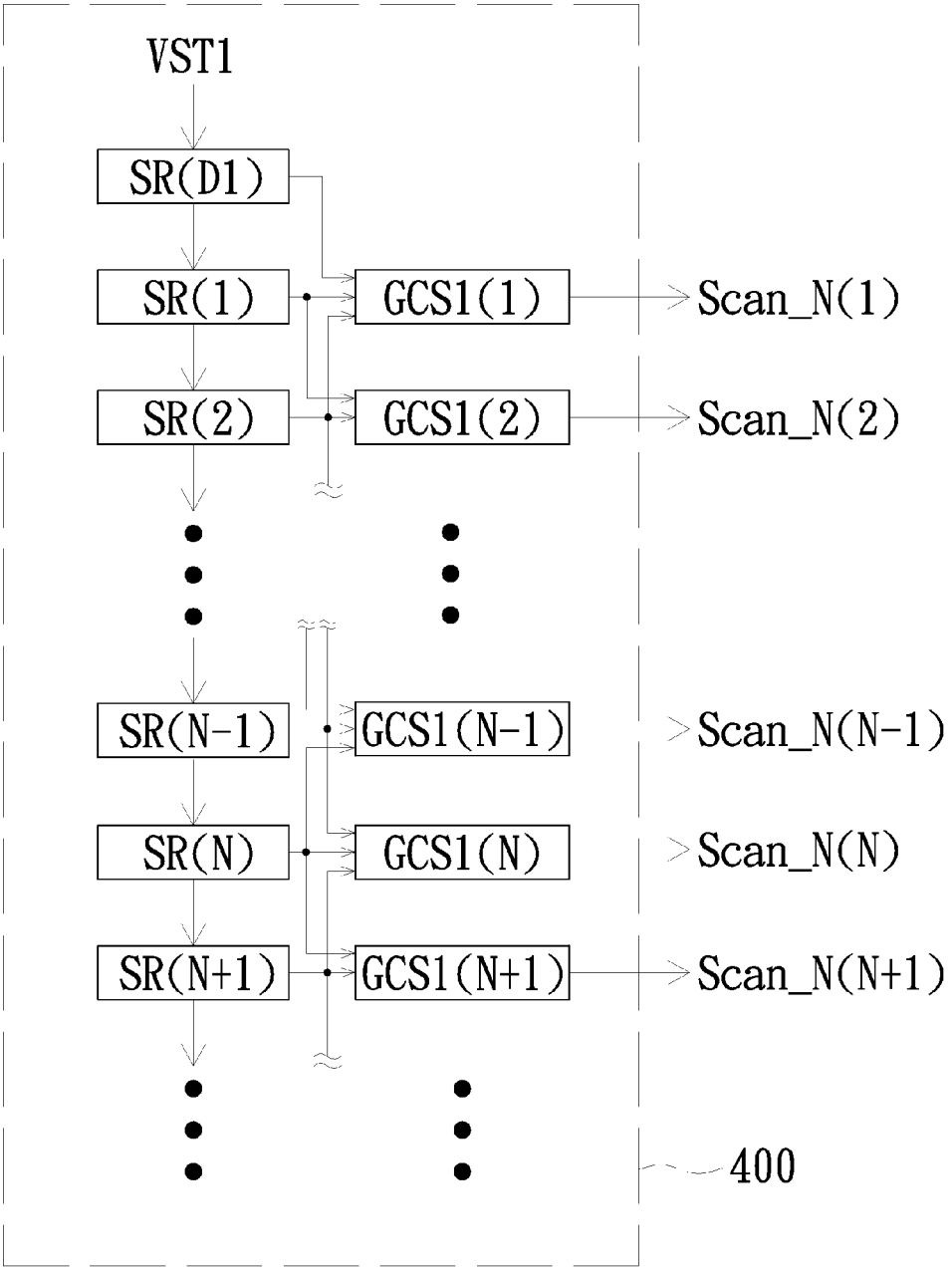
FIG. 4 is a circuit block view of a first gate line driving circuit in accordance with an embodiment of the present disclosure.

Referring to FIG. 4, which is a circuit block view of a first gate line driving circuit in accordance with an embodiment of the present disclosure. As shown, the first gate line driving circuit 400 in the present embodiment includes shift registers SR(D1), SR(1), SR(2), . . . , SR(N−1), SR(N), SR(N+1) and gate control signal generators (also called first gate control signal generators) GCS1(1), GCS1(2), . . . , GCS1(N−1), GCS1(N) and GCS1(N+1). Each one of the gate control signal generators GCS1(1), GCS1(2), . . . , GCS1(N−1), GCS1(N) and GCS1(N+1) is electrically coupled to some of the shift registers SR(D1), SR(1), SR(2), . . . , SR(N−1), SR(N) and SR(N+1) and is configured to generate the first control signals Scan_N(1), Scan_N(2), . . . , Scan_N(N−1), Scan_N(N) and Scan_N(N+1) respectively according to the outputs of the respective electrically-coupled shift registers. For example, the gate control signal generator GCS1(1) is connected to the shift registers SR(D1), SR(1) and SR(2) and accordingly generate the first control signal Scan_N(1); the gate control signal generator GCS1(N) is connected to the shift registers SR(N−1), SR(N) and SR(N+1) and accordingly generate the first control signal Scan_N(N); and so on. In other words, the shift register SR(1) is connected to the gate control signal generators GCS1(1), GCS1(2); the shift register SR(2) is connected to the gate control signal generators GCS1(1), GCS1(2) and GCS1(3); the shift register SR(N) is connected to the gate control signal generators GCS1(N−1), GCS1(N) and GCS1(N+1); and so on.

As shown in FIG. 4, the shift registers SR(D1), SR(1), SR(2), . . . , SR(N−1), SR(N) and SR(N+1) are sequentially electrically coupled in a cascade manner. Specifically, a start signal VST1 is provided to the shift register SR(D1) firstly; then, an output signal is generated by the shift register SR(D1) through an operation of the shift register SR(D1) and the output signal is then transmitted from the shift register SR(D1) to the next-stage shift register SR(1); and so on. This signal generation and transmission process is like that the start signal VST1 has a time delay performed by the shift register SR(D1) first and then transmitted to the shift register SR(1); wherein the aforementioned signal generation and transmission process is the foundation of an operation of the cascaded shift registers. Form another viewpoint, the meaning of the output signal of the shift register SR(D1) to the shift register SR(1) is equivalent to the meaning of the start signal VST1 to the shift register SR(D1). In other words, the output of the shift register SR(D1) is the start signal required for an operation of the shift register SR(1); the output of the shift register SR(1) is the start signal required for an operation of the shift register SR(2); the output of the shift register SR(N−1) is the start signal required for an operation of the shift register SR(N); and the output of the shift register SR(N) is the start signal required for an operation of the shift register SR(N+1).

In addition, it is to be noted that the shift register SR(D1) corresponds to no first gate control signal generator. In the present embodiment, the shift register SR(D1) is used to adjust the timings of signals and generate the start signal for the next-stage shift register; thus, the shift register SR(D1) is also referred to as a dummy shift register. The number of dummy shift register is not limited but generally is selected based on the sequence of input or output signals in time. Thus, the number of the dummy shift register in the present embodiment is not limited to one and can be adjusted in response to the actual needs.

Figure 5:
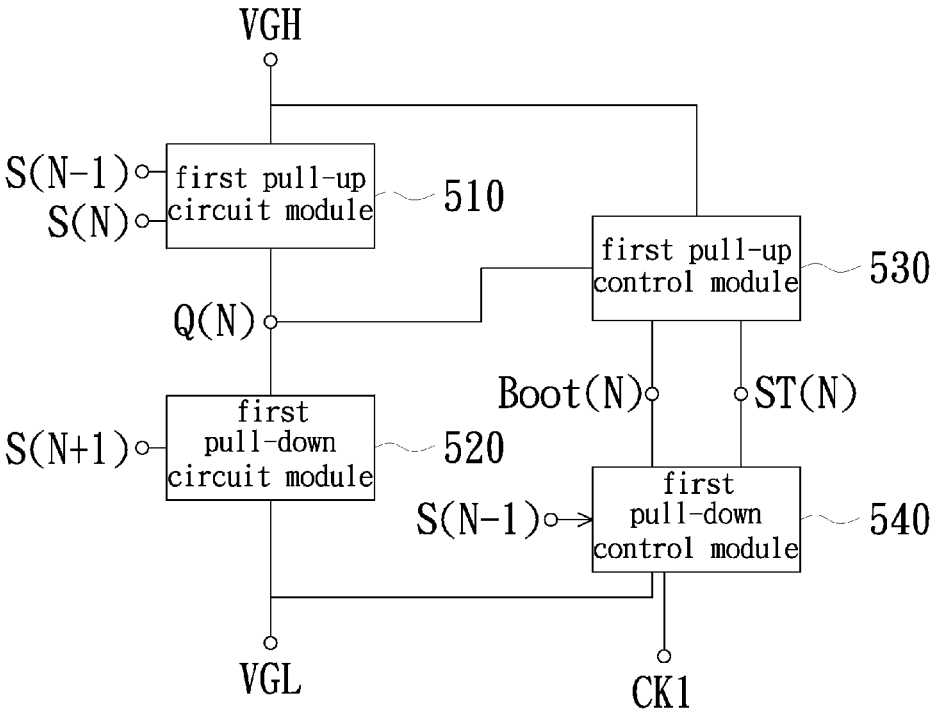
FIG. 5 is a circuit block view of a shift register in a first gate line driving circuit in accordance with an embodiment of the present disclosure.

Next, referring to FIG. 5, which is a circuit block view of a shift register in the first gate line driving circuit in accordance with an embodiment of the present disclosure. As shown, the Nth-stage shift register 500 in the present embodiment includes a first pull-up circuit module 510, a first pull-down circuit module 520, a first pull-up control module 530 and a first pull-down control module 540. Specifically, the first pull-up circuit module 510 is configured to receive a first operation voltage level VGH and the start signal S(N−1) provided from the previous-stage (the (N−1)th-stage) shift register to the Nth-stage shift register and determine whether to turn on an electrical channel between the first operation voltage level VGH and a first control node Q(N) or not according to the start signal S(N−1) and the start signal S(N) provided by the Nth-stage shift register. The first pull-down circuit module 520 is configured to receive a second operation voltage level VGL and the start signal S(N+1) provided from the next-stage (the (N+1)th-stage) shift register and determine whether to turn on an electrical channel between the second operation voltage level VGL and the first control node Q(N) or not according to the start signal S(N+1). The first pull-up control module 530 is electrically coupled to the first control node Q(N) and configured to receive the first operation voltage level VGH and determine whether to turn on an electrical channel between the first operation voltage level VGH and a second control node Boot(N) and an electrical channel between the first operation voltage level VGH and a start signal node ST(N) or not according to the voltage level at the first control node Q(N). The first pull-down control module 540 is configured to receive a clock signal CK1, the second operation voltage level VGL and the start signal S(N−1) provided from the (N−1)th-stage shift register and determine whether to transmit the second operation voltage level VGL to the second control node Boot(N) or not according to start signal S(N−1) and determine whether to turn on an electrical channel between the clock signal CK1 and the start signal node ST(N) or not according to the voltage level at the second control node Boot(N). In addition, it is to be noted that the start signal S(N) provided by the Nth-stage shift register is constituted by the voltage level at the start signal node ST(N); and the voltage level at the second control node Boot(N) is also referred to as an output signal provided to the shift register LSR(N).

The circuit structure of the shift register of the present disclosure will be described in detail in the following embodiments. It is to be noted that the transistors in each following embodiment are exemplarily implemented with P-type transistors. However, because being functioned as switches, these P-type transistors can be replaced by other types of switches as long as the functions of the each aforementioned module are realized, and the present disclosure is not limited thereto.

Figure 6:
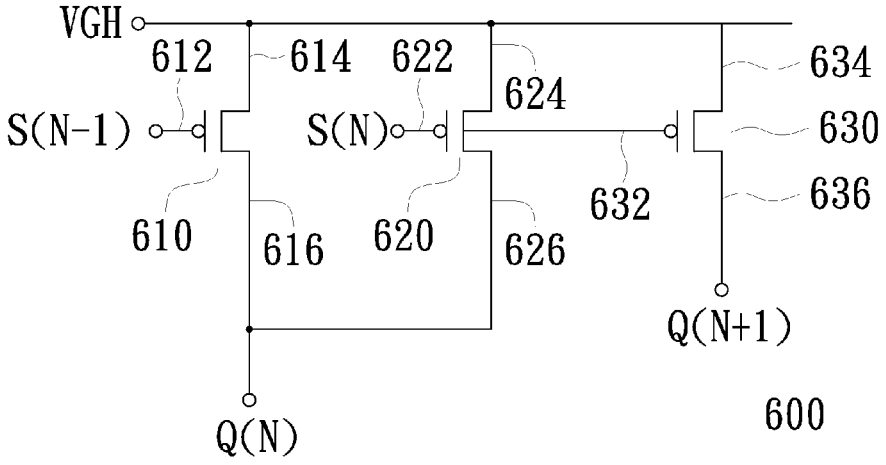
FIG. 6 is a detailed circuit view of a first pull-up circuit module in a shift register in accordance with an embodiment of the present disclosure.

FIG. 6 is a detailed circuit view of a first pull-up circuit module in a shift register in accordance with an embodiment of the present disclosure. As shown, the first pull-up circuit module 600 in the present embodiment includes P-type transistors 610, 620 and 630. The P-type transistor 610 is configured to have its control terminal 612 for receiving the start signal S(N−1) provided by the previous-stage (the (N−1)th-stage) shift register; its channel terminal 614 for receiving the first operation voltage level VGH; and its channel terminal 616 electrically coupled to the first control node Q(N). The P-type transistor 620 is configured to have its control terminal 622 for receiving the start signal S(N) provided by the present-stage (the Nth-stage) shift register; its channel terminal 624 for receiving the first operation voltage level VGH; and its channel terminal 626 electrically coupled to the first control node Q(N). The P-type transistor 630 is configured to have its control terminal 632 for receiving the start signal S(N) provided by the present-stage (the Nth-stage) shift register; its channel terminal 634 for receiving the first operation voltage level VGH; and its channel terminal 636 electrically coupled to the first control node Q(N+1) in the next-stage (the (N+1)th-stage) shift register.

Figure 7:
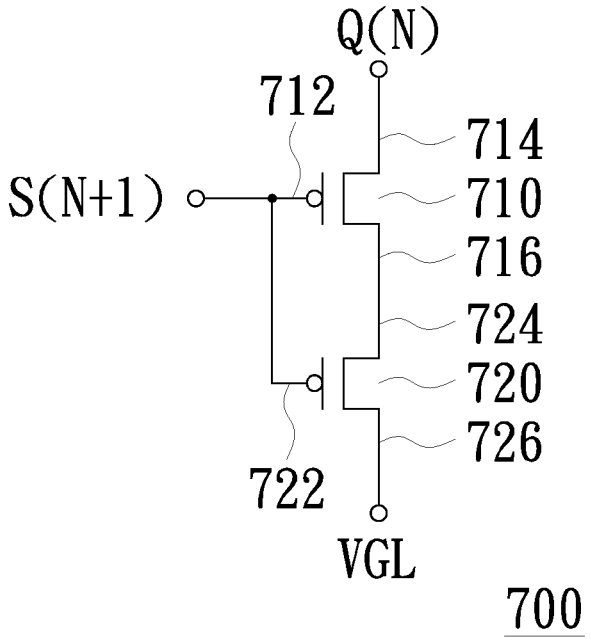
FIG. 7 is a detailed circuit view of a first pull-down circuit module in a shift register in accordance with an embodiment of the present disclosure.

Next, referring to FIG. 7, which is a detailed circuit view of a first pull-down circuit module in a shift register in accordance with an embodiment of the present disclosure. As shown, the first pull-down circuit module 700 in the present embodiment includes P-type transistors 710, 720. The P-type transistor 710 is configured to have its control terminal 712 for receiving the start signal S(N+1); its channel terminal 714 electrically coupled to the first control node Q(N). The P-type transistor 720 is configured to have its control terminal 722 for receiving the start signal S(N+1); its channel terminal 724 electrically coupled to the channel terminal 716 of the P-type transistor 710; and its channel terminal 726 for receiving the second operation voltage level VGL.

Figure 8:
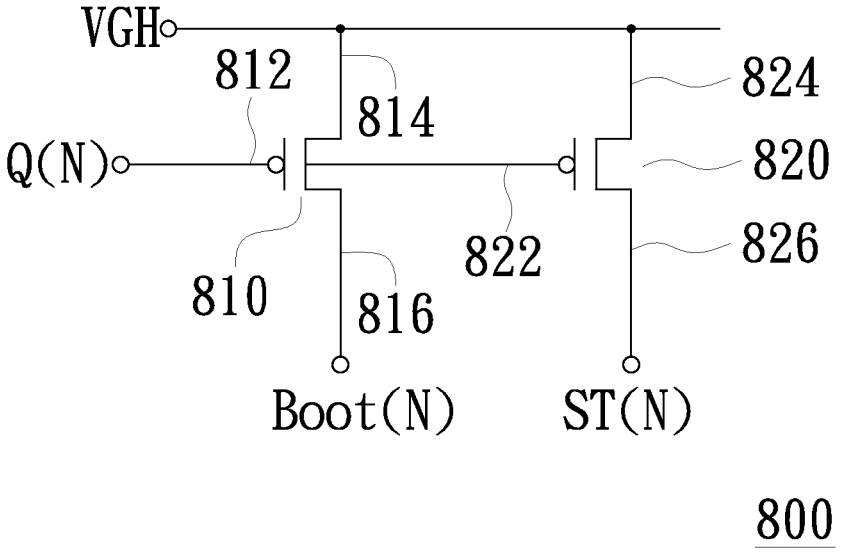
FIG. 8 is a detailed circuit view of a first pull-up control module in a shift register in accordance with an embodiment of the present disclosure.

Next, referring to FIG. 8, which is a detailed circuit view of a first pull-up control module in a shift register in accordance with an embodiment of the present disclosure. As shown, the first pull-up control module 800 in the present embodiment includes P-type transistors 810, 820. The P-type transistor 810 is configured to have its control terminal 812 electrically coupled to the first control node Q(N); its channel terminal 814 for receiving the first operation voltage level VGH; and its channel terminal 816 electrically coupled to the second control node Boot(N). The P-type transistor 820 is configured to have its control terminal 822 electrically coupled to the first control node Q(N); its channel terminal 824 for receiving the first operation voltage level VGH; and its channel terminal 826 electrically coupled to the start signal node ST(N).

Figure 9:
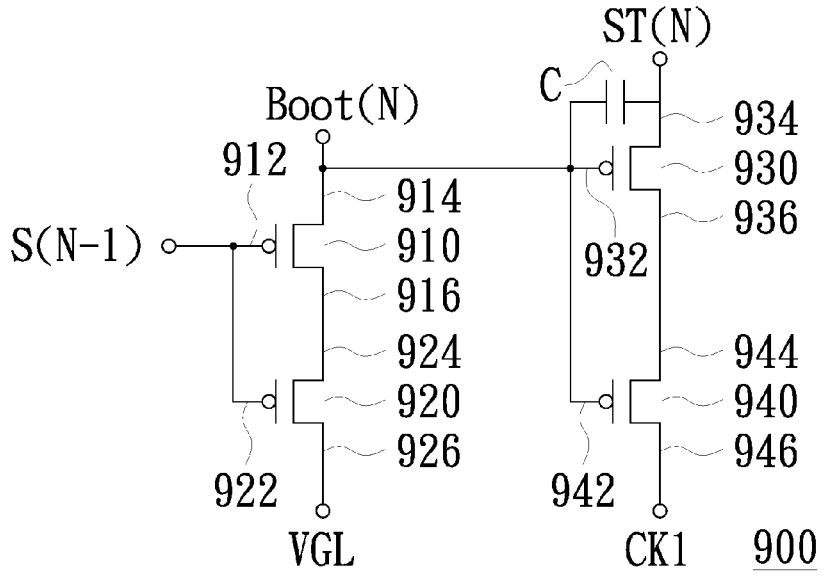
FIG. 9 is a detailed circuit view of a first pull-down control module in a shift register in accordance with an embodiment of the present disclosure.

Next, referring to FIG. 9, which is a detailed circuit view of a first pull-down control module in a shift register in accordance with an embodiment of the present disclosure. As shown, the first pull-down control module 900 in the present embodiment includes P-type transistors 910, 920, 930 and 940 and a capacitor C. The P-type transistor 910 is configured to have its control terminal 912 for receiving the start signal ST(N−1) provided by the previous-stage (the (N−1)th-stage) shift register and its channel terminal 914 electrically coupled to the second control node Boot(N). The P-type transistor 920 is configured to have its control terminal 922 for receiving the start signal S(N−1); its channel terminal 924 electrically coupled to the channel terminal 916 of the P-type transistor 910; and its channel terminal 926 for receiving the second operation voltage level VGL. The P-type transistor 930 is configured to have its control terminal 932 electrically coupled to the second control node Boot(N) and its channel terminal 934 electrically coupled to the start signal node ST(N). The P-type transistor 940 is configured to have its control terminal 942 electrically coupled to the second control node Boot(N); its channel terminal 944 electrically coupled to the channel terminal 936 of the P-type transistor 930; and its channel terminal 946 for receiving the clock signal CK1. The capacitor C is configured to have its first terminal electrically coupled to the second control node Boot(N) and its second terminal electrically coupled to the start signal node ST(N).

Figure 10:
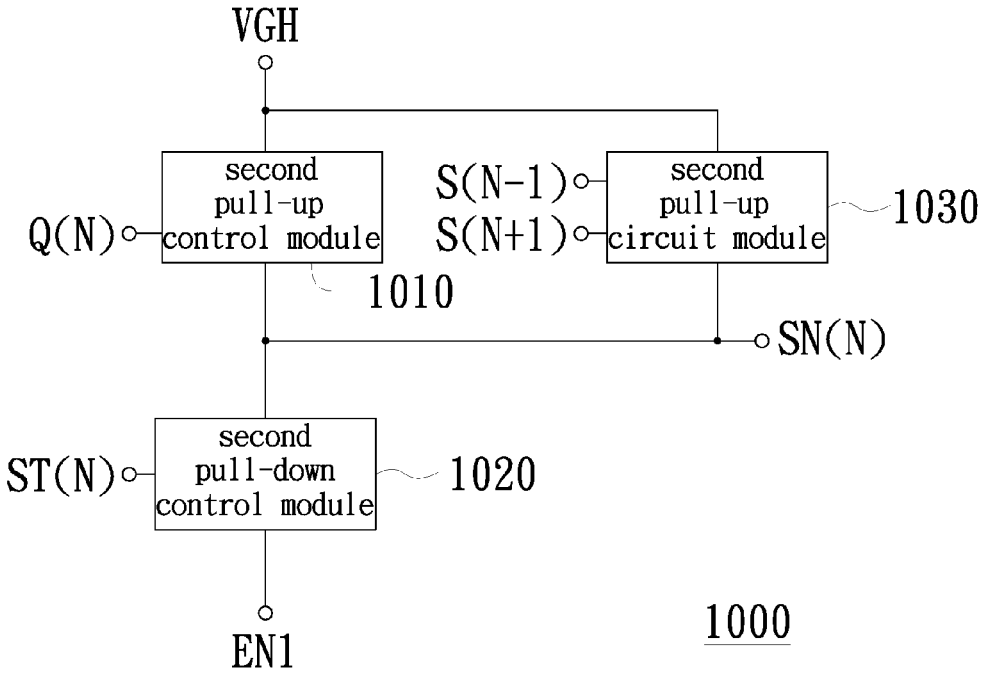
FIG. 10 is a circuit block view of a gate control signal generator in a first gate line driving circuit in accordance with an embodiment of the present disclosure.

The internal circuit of the gate control signal generator will be described as follow with a reference of related figures. Referring to FIG. 10, which is a circuit block view of a gate control signal generator in accordance with an embodiment of the present disclosure. As shown, the gate control signal generator 1000 in the present embodiment includes a second pull-up control module 1010, a second pull-down control module 1020 and a second pull-up circuit module 1030. As shown, besides for receiving the first operation voltage level VGH, the second pull-up control module 1010 is further electrically coupled to the first control node Q(N) and the gate control signal output node SN(N) and thereby being configured to determine whether to turn on an electrical channel from the first operation voltage level VGH to the gate control signal output node SN(N) or not according to the voltage level at the first control node Q(N). Besides for receiving the enable signal EN1, the second pull-down control module 1020 is further electrically coupled to the start signal node ST(N) and the gate control signal output node SN(N) and thereby being configured to determine whether to turn on an electrical channel from the enable signal EN1 to the gate control signal output node SN(N) or not according to the voltage level at the gate control signal output node SN(N). Besides for receiving the start signal S(N−1) provided by the previous-stage (the (N−1)th-stage) shift register, the start signal S(N+1) provided by the next-stage (the (N+1)th-stage) shift register and the first operation voltage level VGH, the second pull-up circuit module 1030 is further electrically coupled to the gate control signal output node SN(N) and thereby being configured to determine whether to turn on an electrical channel from the first operation voltage level VGH to the gate control signal output node SN(N) or not according to the start signal S(N−1) and the start signal S(N+1). In addition, it is to be noted that the first control signal Scan_N (N) provided by the Nth-stage shift register is constituted by the voltage level at the gate control signal output node SN(N).

Figure 11:
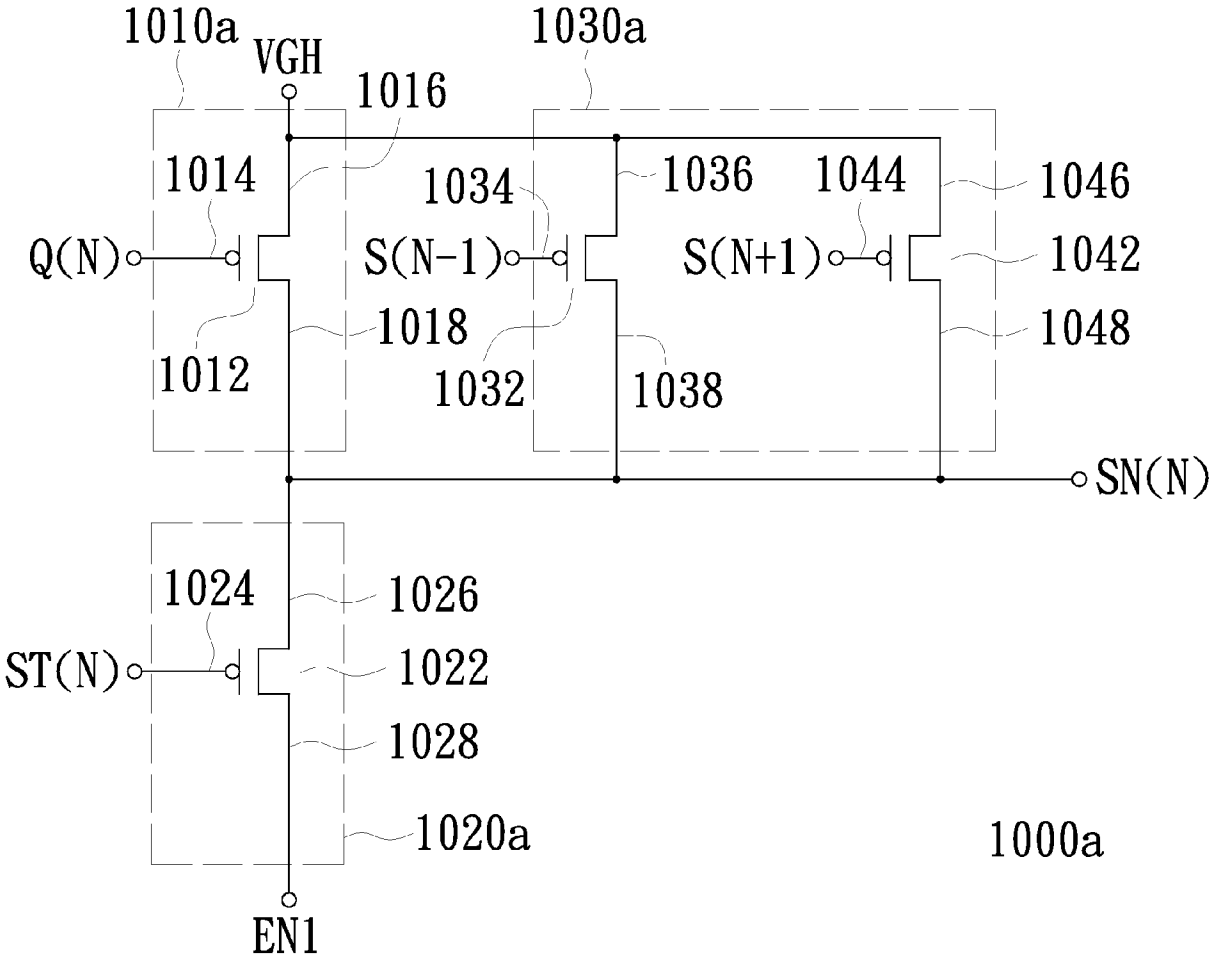
FIG. 11 is a detailed circuit view of a gate control signal generator in a first gate line driving circuit in accordance with an embodiment of the present disclosure.

FIG. 11 is a detailed circuit view of a gate control signal generator in accordance with an embodiment of the present disclosure. As shown, the gate control signal generator 1000*a* in the present embodiment includes a second pull-up control module 1010*a*, a second pull-down control module 1020*a* and a second pull-up circuit module 1030*a*. The second pull-up control module 1010*a* includes a P-type transistor 1012. The P-type transistor 1012 is configured to have its control terminal 1014 electrically coupled to the first control node Q(N); its channel terminal 1016 for receiving the first operation voltage level VGH; and its channel terminal 1018 electrically coupled to the gate control signal output node SN(N). The second pull-down control module 1020*a* includes a P-type transistor 1022. The P-type transistor 1022 is configured to have its control terminal 1024 electrically coupled to the start signal node ST(N); its channel terminal 1026 electrically coupled to the gate control signal output node SN(N); and its channel terminal 1028 for receiving the enable signal EN1. The second pull-up circuit module 1030*a* includes P-type transistors 1032, 1042. The P-type transistor 1032 is configured to have its control terminal 1034 for receiving the start signal S(N−1) provided by the previous-stage (the (N−1)th-stage) shift register; its channel terminal 1036 for receiving the first operation voltage level VGH; and its channel terminal 1038 electrically coupled to the gate control signal output node SN(N). The P-type transistor 1042 is configured to have its control terminal 1044 for receiving the start signal S(N+1) provided by the next-stage (the (N+1)th-stage) shift register; its channel terminal 1046 for receiving the first operation voltage level VGH; and its channel terminal 1048 electrically coupled to the gate control signal output node SN(N).

Figure 12:
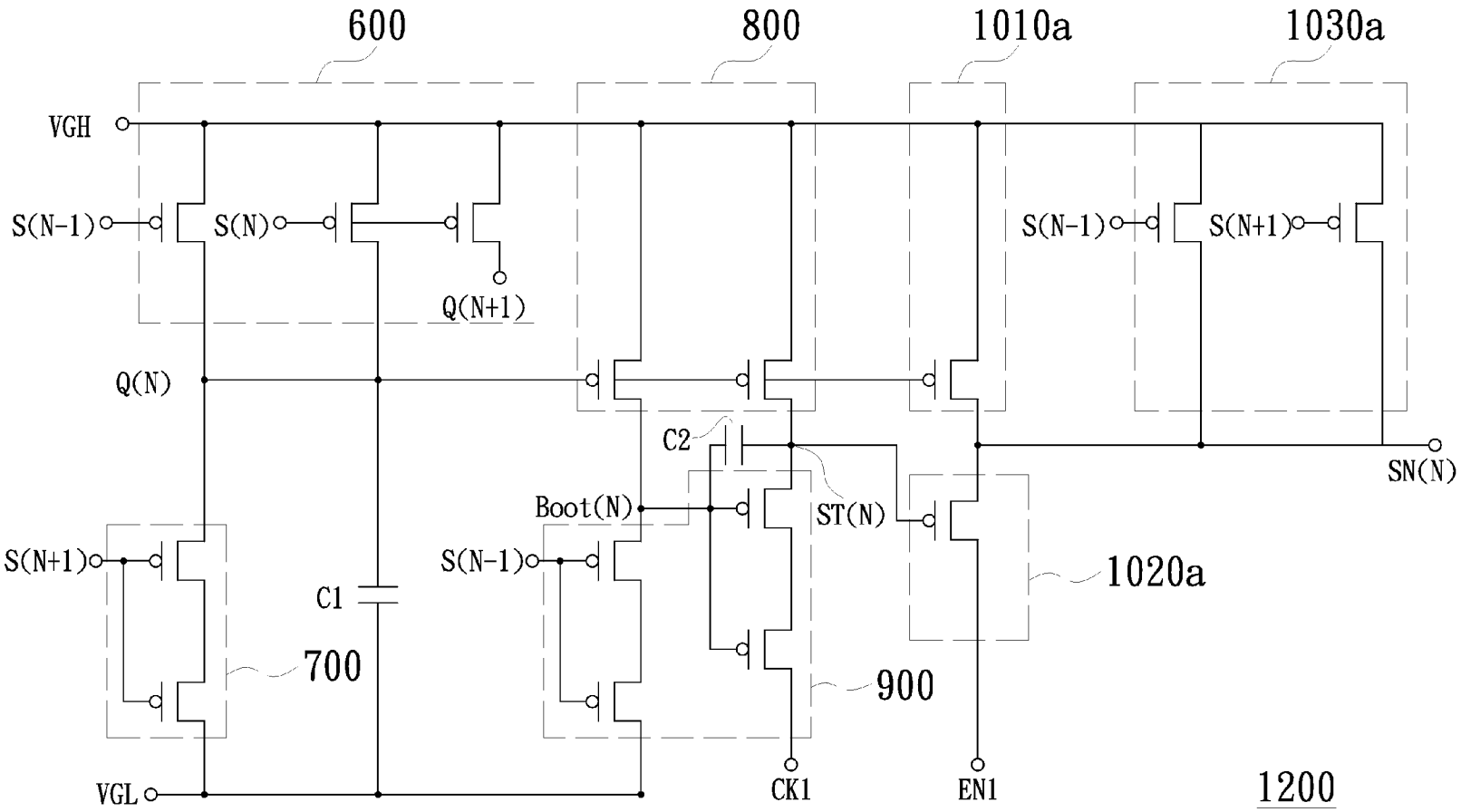
FIG. 12 is a detailed circuit view of a shift register and a respective gate control signal generator in a first gate line driving circuit in accordance with an embodiment of the present disclosure.

Through a combination of the aforementioned embodiments, a detailed circuit view consisting of one stage of shift register and a related gate control signal generator is obtained as illustrated in FIG. 12. As shown, most of the circuit components and the connection ways among the components in the circuit 1200 of FIG. 12 have been described in FIGS. 5-11, and no redundant detail is to be given herein. Further, to stabilize the operation of the circuit 1200, the circuit 1200 further includes a capacitor C1. In addition, the capacitor C2 in the circuit 1200 is equivalent to the capacitor C in FIG. 9. The capacitor C1 is configured to have its first terminal electrically coupled to the first control node Q(N) and its second terminal for receiving the second operation voltage level VGL. The detailed operation of the circuit 1200 will be described as follow with a reference of related timing charts.

Figure 13:
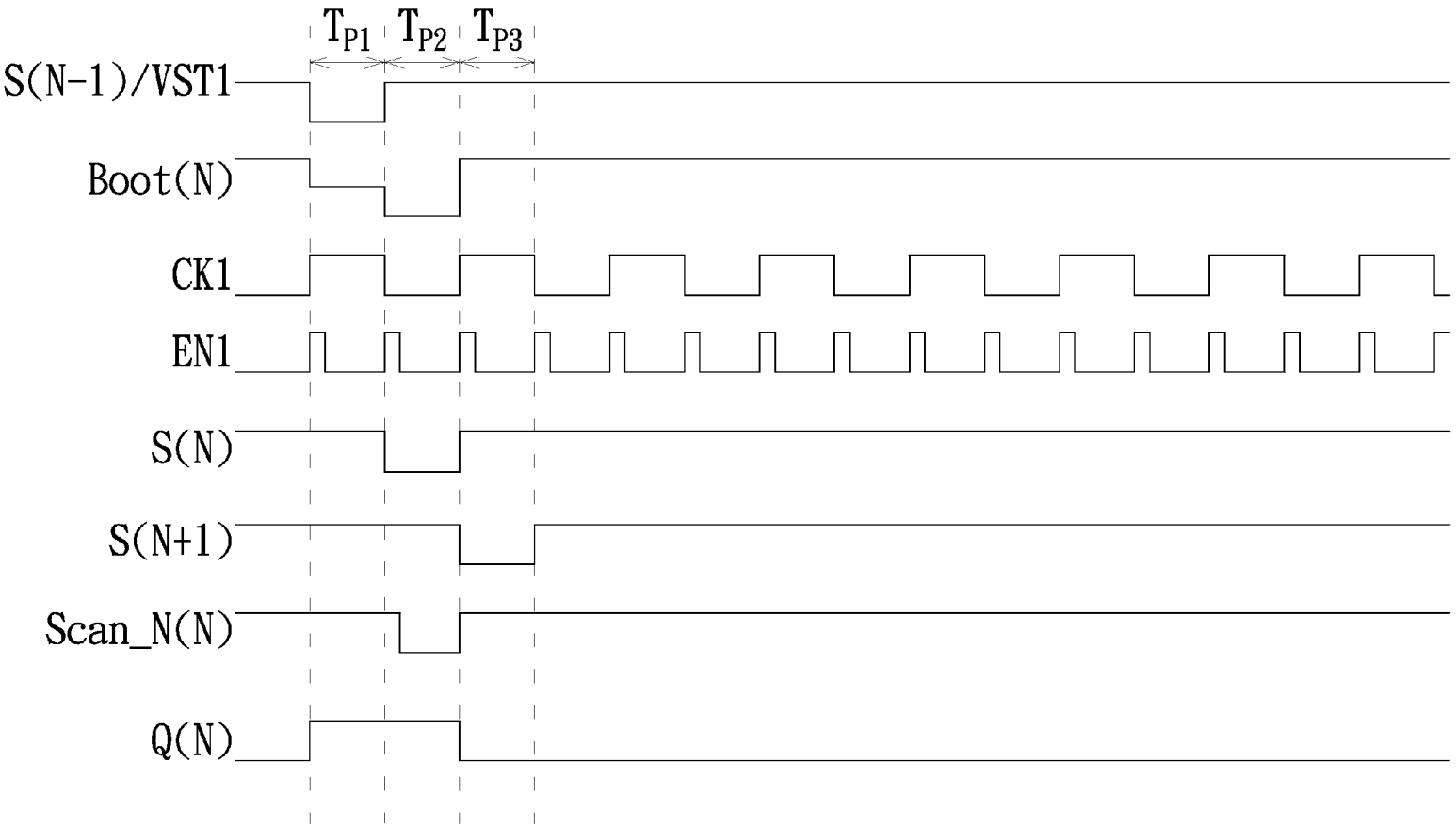
FIG. 13 is an operation timing chart of a shift register and a respective gate control signal generator in a first gate line driving circuit in accordance with an embodiment of the present disclosure.

FIG. 13 is an operation timing chart of a first gate line driving circuit in accordance with an embodiment of the present disclosure. To facilitate a better understanding of the present disclosure, please refer to FIG. 13 with FIGS. 5-12 together.

Firstly, as described above, it is understood that for the first-stage shift register, its input waveform is the initially-provided start signal VST1. For the Nth-stage shift register and its corresponding gate control signal generator, its input waveform is the output signal of the (N−1)th-stage shift register (that is, the start signal S(N−1) provided by the (N−1)th-stage shift register). The following description will be described mainly based on the Nth-stage shift register.

As shown in FIG. 13, the start signal S(N−1) is converted from a high-voltage level to a low-voltage level at the beginning of the operation period $T_{P1}$, and then is maintained at a low-voltage level during the operation period $T_{P1}$. Thus, during the operation period $T_{P1}$, the P-type transistor 610 in FIG. 6, the P-type transistors 910, 920 in FIG. 9 and the P-type transistor 1032 in FIG. 11 are turned on. Accordingly, the electrical channel between the first control node Q(N) and the first operation voltage level VGH is turned on by the P-type transistor 610; the electrical channel between the second control node Boot(N) and the second operation voltage level VGL is turned on by the P-type transistors 910, 920; and the electrical channel between the gate control signal output node SN(N) and the first operation voltage level VGH is turned on by the P-type transistor 1032. Therefore, during the operation period $T_{P1}$, the voltage levels at the first control node Q(N) and the gate control signal output node SN(N) are maintained at a high-voltage level; and the voltage level at the second control node Boot(N) is pulled down from a high-voltage level to a low-voltage level (about the second operation voltage level VGL).

Because being constituted by the voltage level at the gate control signal output node SN(N), the first control signal Scan_N(N) is maintained at a high-voltage level during the operation period $T_{P1}$.

Because the voltage level at the first control node Q(N) is maintained at a high-voltage level during the operation period $T_{P1}$, the P-type transistors 810, 820 in FIG. 8 and the P-type transistor 1012 in FIG. 11 are turned off. In contrast, because the voltage level at the second control node Boot(N) is pulled down to a low-voltage level during the operation period $T_{P1}$, the P-type transistors 930, 940 in FIG. 9 are turned on; and consequentially the electrical channel between the start signal node ST(N) and the clock signal CK1 is turned on by the P-type transistors 930, 940. Therefore, same as the clock signal CK1, the voltage level at the start signal node ST(N) is maintained at a high-voltage level during the operation period $T_{P1}$. Because the voltage level at the start signal node ST(N) is maintained at a high-voltage level, the start signal S(N) is also maintained at a high-voltage level. Thus, the P-type transistors 620, 630 in FIG. 6 and the transistor 1022 in FIG. 11 also are maintained in a turned-off state.

As shown in FIG. 13, when the operation period $T_{P1}$ is end, the start signal S(N−1) is converted from a low-voltage level to a high-voltage level at the beginning of the operation period $T_{P2}$ and then is maintained at the high-voltage level during the operation period $T_{P2}$. With the start signal S(N−1) being converted from a low-voltage level to a high-voltage level, the P-type transistor 610 in FIG. 6, the P-type transistors 910, 920 in FIG. 9 and the P-type transistor 1032 in FIG. 11 are converted from a turned-on state to a turned-off state. Therefore, the P-type transistors 610, 910, 920 and 1032 are maintained in a turned-off state during the operation period $T_{P2}$. Accordingly, the voltage level at the first control node Q(N) is maintained and has no change; and the voltage level at the second control node Boot(N) is further pulled down to a lower voltage level (lower than the second operation voltage level VGL) due to the couple effect between the P-type transistor 910 and the capacitor C2. By being pulled down, the voltage level at the second control node Boot(N) is lower than the low-voltage level of the clock signal CK1 during the operation period $T_{P2}$. Thus, the P-type transistors 930, 940 in FIG. 9 are maintained in a turn-on state; and consequentially the electrical channel between the start signal node ST(N) and the clock signal CK1 is maintained to be turned on by the P-type transistors 930, 940. Therefore, same as the clock signal CK1, the voltage level at the start signal node ST(N) is maintained at a low-voltage level during the operation period $T_{P2}$.

Because the voltage level at the start signal node ST(N) is converted to a low-voltage level during the operation period $T_{P2}$, the P-type transistor 620 in FIG. 6 is turned on thereby stabilizing the voltage level at the first control node Q(N) in a high-voltage state. In the meantime, the P-type transistor 630 in FIG. 6 is also turned on based on the same reason, and the voltage level at the first control node Q(N+1) in the next-stage (the (N+1)th-stage) shift register is pulled up and stabilized in a high-voltage state. Because the first control node Q(N) is stable in a high-voltage state and the voltage level at the start signal node ST(N) is converted to a low-voltage state, the P-type transistor 1012 in FIG. 11 is turned off but the P-type transistor 1022 is turned on.

According to the aforementioned operation of the present-stage (the Nth-stage) shift register, it is to be noted that the start signal S(N) of the present-stage (the Nth-stage) shift register is converted to a low-voltage level when the start signal S(N−1) of the previous-stage (the (N−1)th-stage) shift register is converted to a high-voltage level; so the start signal S(N+1) of the next-stage (the (N+1)th-stage) shift register is maintained in a high-voltage state during the operation period $T_{P2}$ on this basis. Therefore, the P-type transistor 1042 in FIG. 11 is also maintained in a turned-off state during the operation period $T_{P2}$.

According to the above description, the P-type transistors 1012, 1032 and 1042 in FIG. 11 are maintained in a turned-off state during the operation period $T_{P2}$; and the P-type transistor 1022 is in a turned-on state. Therefore, the electrical channel between the gate control signal output node SN(N) and the enable signal EN1 is turned on. Thus, same as the enable signal EN1, the voltage level at the gate control signal output node SN(N) is maintained in a low-voltage state after a high-voltage pulse of the enable signal EN1 during the operation period $T_{P2}$.

Also, because the first control signal Scan_N(N) is constituted by the voltage level at the gate control signal output node SN(N), the first control signal Scan_N(N) also drops to a low-voltage level along with the enable signal EN1 dropping to a low-voltage level during the operation period $T_{P2}$.

Then, as shown in FIG. 13, when the operation period $T_{P2}$ is end, the start signal S(N+1) is converted from a high-voltage level to a low-voltage level at the beginning of the operation period $T_{P3}$ and then is maintained at the low-voltage level during the operation period $T_{P3}$. With the start signal S(N+1) being converted from a high-voltage level to a low-voltage level, the P-type transistors 710, 720 in FIG. 7 are converted from a turned-off state to a turned-on state; and consequentially the electrical channel between the first control node Q(N) and the second operation voltage level VGL is turned on. Accordingly, the voltage level at the first control node Q(N) is pulled down to a lower voltage level (about the second operation voltage level VGL); and consequentially the P-type transistors 810, 820 in FIG. 8 and the P-type transistor 1012 in FIG. 11 are turned on. In addition, when the start signal S(N+1) is converted to a low-voltage level, the P-type transistor 1042 in FIG. 11 is turned. Accordingly, the electrical channel between the gate control signal output node SN(N) and the first operation voltage level VGH is turned on by the P-type transistors 1012, 1042, and the voltage level at the gate control signal output node SN(N) is pulled up to a high-voltage level.

Also, because the first control signal Scan_N(N) is constituted by the voltage level at the gate control signal output node SN(N), the first control signal Scan_N(N) is also pulled up to a high-voltage level during the operation period $T_{P3}$.

Furthermore, as described above, because the voltage level at the first control node Q(N) is pulled down to a low-voltage level, the P-type transistors 810, 820 are turned on; and consequentially the electrical channel between the second control node Boot(N) and the first operation voltage level VGH is turned on by the P-type transistor 810 and the electrical channel between the gate control signal output node ST(N) and the first operation voltage level VGH is turned on by the P-type transistor 820. Accordingly, both of the voltage levels at the second control node Boot(N) and the start signal node ST(N) are pulled to a high-voltage level, which is close to first operation potential VGH. Also, because the start signal S(N) is constituted by the voltage level at the gate control signal output node ST(N), the start signal S(N) is converted from a low-voltage level to a high-voltage level and is maintained in the high-voltage level during the operation period $T_{P3}$.

Figure 14A:
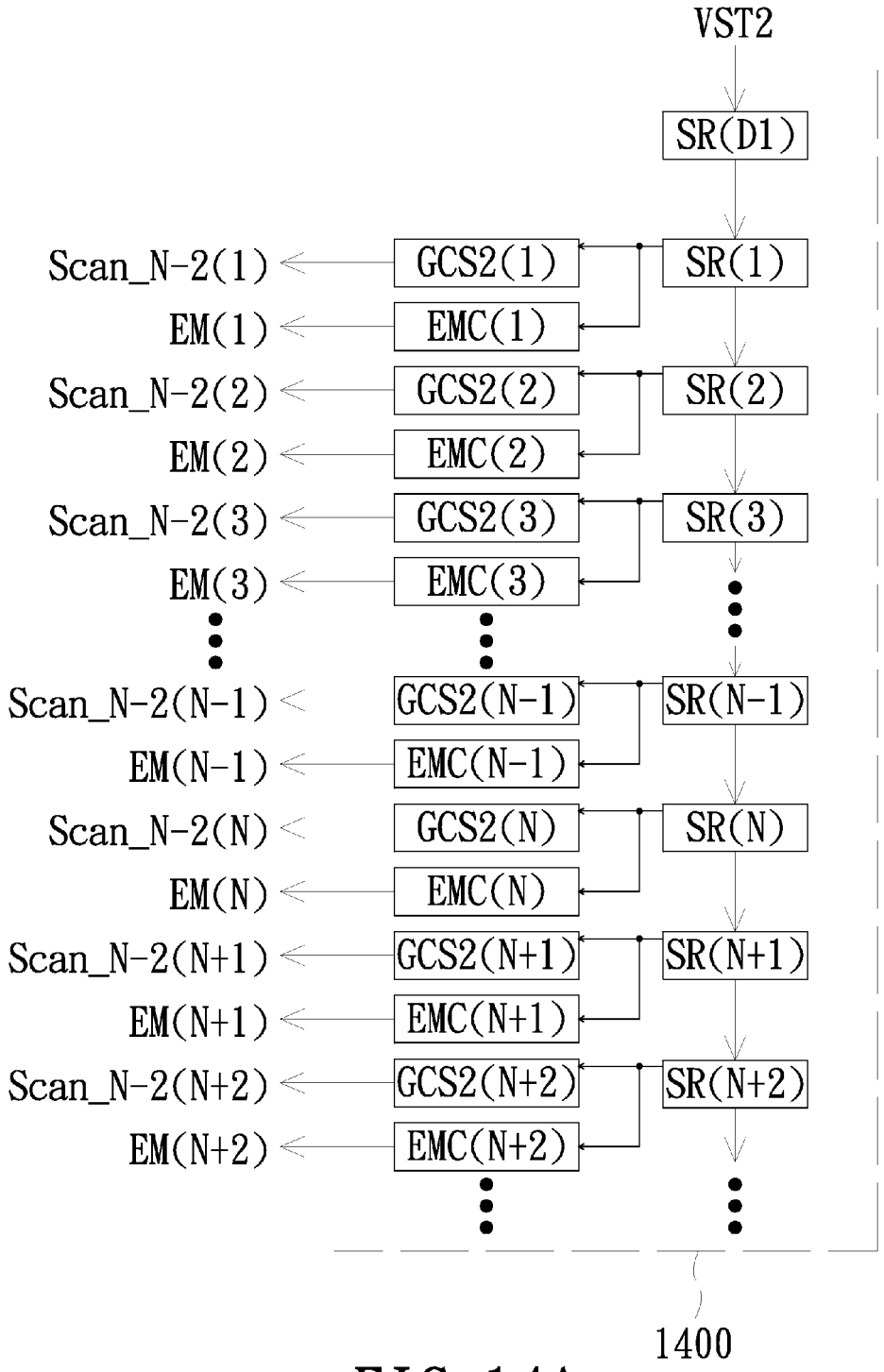
FIG. 14A is a circuit block view of a second gate line driving circuit in accordance with an embodiment of the present disclosure.

FIG. 14A is a circuit block view of a second gate line driving circuit in accordance with an embodiment of the present disclosure. As shown, the second gate line driving circuit 1400 in the present embodiment includes a plurality of shift registers, such as shift register SR(D1), SR(1), SR(2), SR(3), . . . , SR(N−1), SR(N), SR(N+1) and SR(N+2), a plurality of gate control signal generators, such as gate control signal generators GCS2(1), GCS2(2), GCS2(3), . . . , GCS2(N−1), GCS2(N), GCS2(N+1) and GCS2(N+2) and a plurality of light emitting control signal generators, such as light emitting control signal generators EMC(1), EMC(2), EMC(3), . . . , EMC(N−1), EMC (N), EMC(N+1) and EMC(N+2). The shift registers SR(D1), SR(1), SR(2), SR(3), . . . , SR(N−1), SR(N), SR(N+1) and SR(N+2) are sequentially coupled in a cascade manner and configured to sequentially transmit a start signal VST2 as illustrated in FIG. 4. Furthermore, each gate control signal generator and each light emitting control signal generator are electrically coupled to a plurality of respective shift registers thereby generating a respective second control signal and a respective light emitting control signal according to the outputs of the electrically-coupled shift registers, respectively.

It is to be noted that the shift registers used in the present embodiment of FIG. 14A are same as the shift registers used in the embodiment of FIG. 4, thus the shift registers in FIG. 14A and the shift registers in FIG. 4 have the same label numbers. However, it is to be noted that the gate control signal generator used in the present embodiment is different with that in the embodiment of FIG. 4. In addition, it is understood that the second gate line driving circuit 1400 in the present embodiment is not limited to use the shift registers same as those in the first gate line driving circuit. In fact, any shift register or gate control signal generator capable of achieving the same purpose are also adapted to be used in the second gate line driving circuit 1400.

Each gate control signal generator (e.g., the gate control signal generator GCS2(N)) in FIG. 14A is exemplarily illustrated having one electrical channel with the respective shift register (e.g., the shift register SR(N)) only; however, it is to be noted that each gate control signal generator may be electrically coupled to more than one shift register. Similarly, each light emitting control signal generator may be electrically coupled to more than one shift register. In addition, to facilitate a better understanding of the present disclosure, only some electrical channels are illustrated in FIG. 14A, the detailed electrical channels between one gate control signal generator, light emitting control signal generators and other related circuit components will be described in FIG. 14B.

Figure 14B:
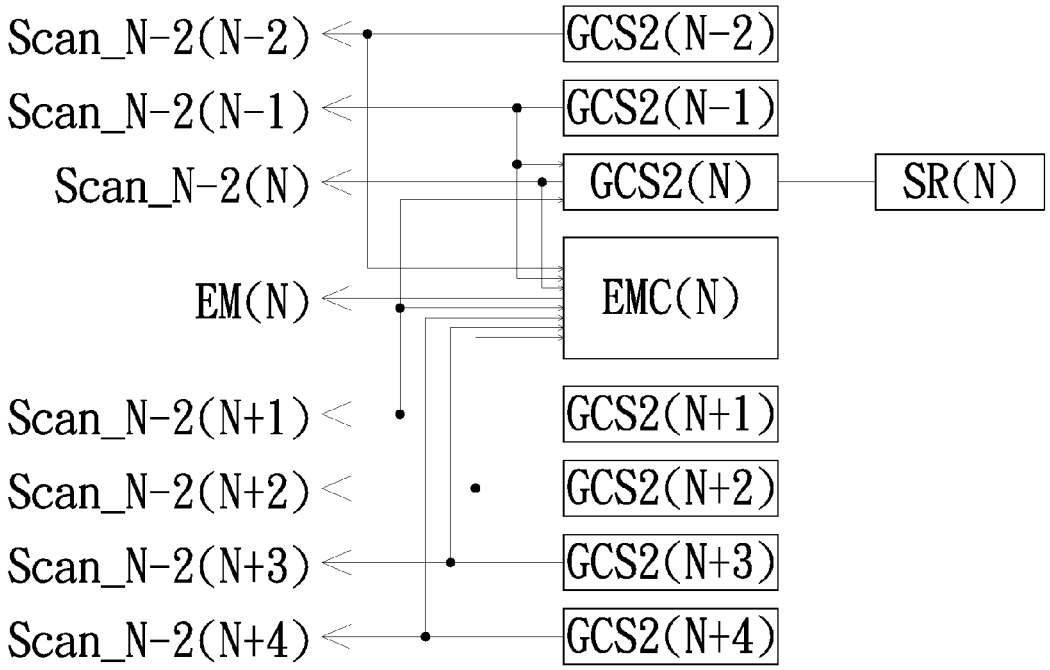
FIG. 14B is a schematic view of electrical channels between a gate control signal generator, respective light emitting control signal generators and other related circuit components in a second gate line driving circuit in accordance with an embodiment of the present disclosure.

Referring to FIG. 14B, which is a schematic view of the electrical channels between one gate control signal generator, light emitting control signal generators and other related circuit components in the second gate line driving circuit in accordance with an embodiment of the present disclosure. In the present embodiment, besides being electrically coupled to the Nth-stage shift register SR(N), the gate control signal generator GCS2(N) corresponding to the Nth-stage shift register SR(N) is further electrically coupled to the gate control signal generators GCS2(N−1), GCS2(N+1), thereby obtaining the corresponding second control signals Scan_N−2(N−1), Scan_N−2(N+1) and outputting the corresponding second control signal Scan_N−2(N). Moreover, the light emitting control signal generator EMC(N) corresponding to the Nth-stage shift register SR(N) is electrically coupled to the gate control signal generators GCS2(N−2), GCS2(N−1), GCS2(N), GCS2(N+1), GCS2(N+2), GCS2(N+3) and GCS2(N+4), thereby obtaining the corresponding second control signals Scan_N−2(N−2), Scan_N−2(N−1), Scan_N−2(N), Scan_N−2(N+1), Scan_N−2(N+2), Scan_N−2(N+3) and Scan_N−2(N+4) and outputting the corresponding light emitting control signal EM(N).

Figure 15:
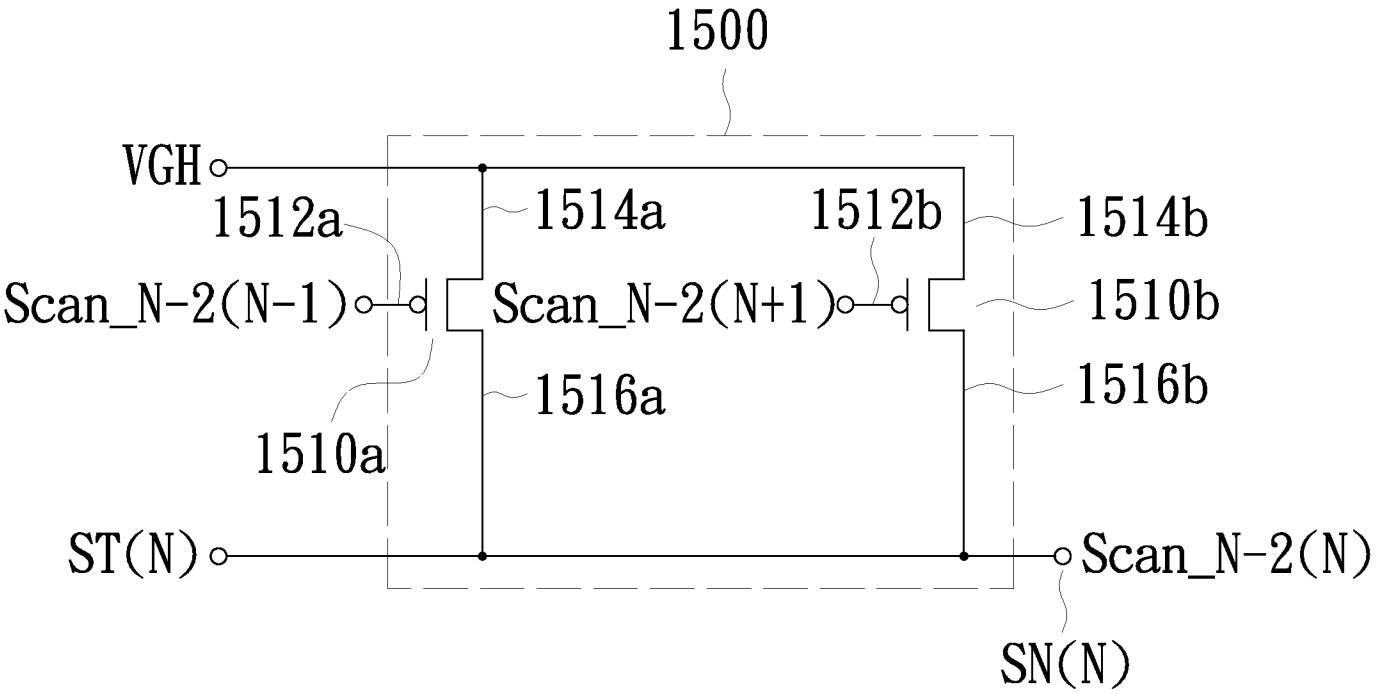
FIG. 15 is a circuit view of a gate control signal generator in a second gate line driving circuit in accordance with an embodiment of the present disclosure.

Referring to FIG. 15, which is a circuit view of a gate control signal generator in the second gate line driving circuit in accordance with an embodiment of the present disclosure. As shown, the gate control signal generator in the present embodiment includes a second pull-up circuit module 1500. The second pull-up circuit module 1500 is electrically coupled to the first operation voltage level VGH, the second control signal Scan_N−2(N−1) outputted from the gate control signal generator GCS2(N−1) corresponding to the previous-stage (the (N−1)th-stage) shift register, the second control signal Scan_N−2(N+1) outputted from the gate control signal generator GCS2(N+1) corresponding to the next-stage (the (N+1)th-stage) shift register, and the start signal S(N) provided by the start signal node ST(N) in the present-stage (the Nth-stage) shift register.

Specifically, the second pull-up circuit module 1500 includes two P-type transistors 1510*a*, 1510*b*. The P-type transistor 1510*a* is configured to have its control terminal 1512*a* for receiving the second control signal Scan_N−2(N−1), its channel terminal 1514*a* for receiving the first operation voltage level VGH, and its channel terminal 1516*a* electrically coupled to the start signal node ST(N). The P-type transistor 1510*b* is configured to have its control terminal 1512*b* for receiving the second control signal Scan_N−2(N+1), its channel terminal 1514*b* for receiving the first operation voltage level VGH, and its channel terminal 1516*b* electrically coupled to the start signal node ST(N). Through the configuration, the second pull-up circuit module 1500 is configured to determine whether to turn on the electrical channel from the first operation voltage level VGH to the start signal node ST(N) or not according to the second control signals Scan_N−2(N−1), Scan_N−2(N+1).

Based on the circuit design of the gate control signal generator in the present embodiment, the start signal node ST(N) in the Nth-stage shift register is electrically coupled to the gate control signal output node SN(N). Thus, in the circuit designed by the present embodiment, the electrical connection to the start signal node ST(N) is equivalent to the electrical connection to the gate control signal output node SN(N). As a result, the second control signal Scan_N−2(N) provided by the Nth-stage shift register is constituted by the voltage level at the start signal node ST(N). Similarly, in the second gate line driving circuit, the received second control signal is equivalent to the start signal provided by the start signal node ST(N) in the respective shift register. For example, the receiving of the second control signal Scan_N−2(N−1) is equivalent to the receiving of the start signal S(N−1) provided by the start signal node ST(N−1) in the (N−1)th-stage shift register.

Figure 16:
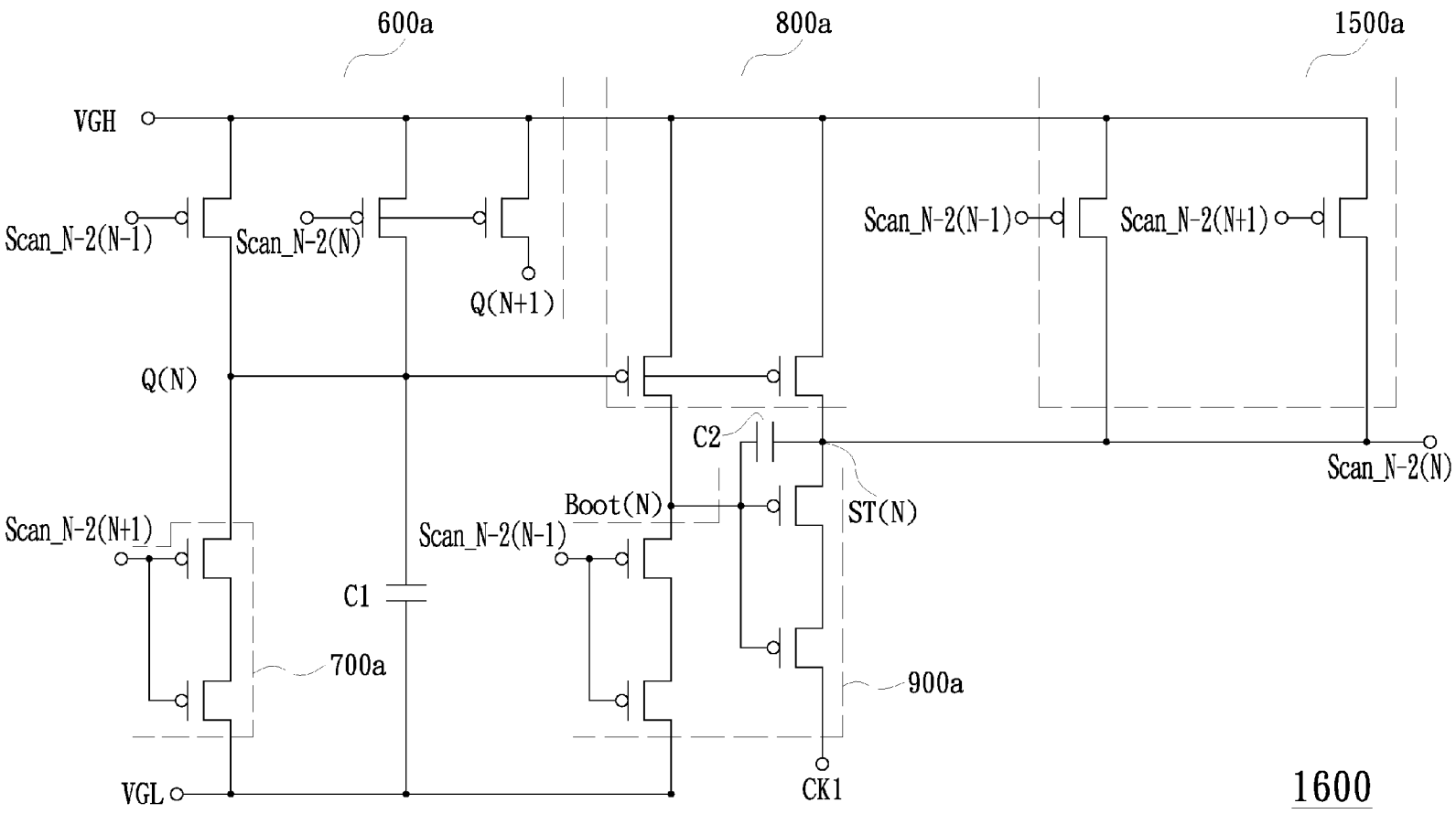
FIG. 16 is a detailed circuit view of a shift register and a respective gate control signal generator in a second gate line driving circuit in accordance with an embodiment of the present disclosure.

FIG. 16 is a detailed circuit view of a shift register and a respective gate control signal generator in the second gate line driving circuit in accordance with an embodiment of the present disclosure. As shown, the circuit 1600 in the present embodiment includes a first pull-up circuit module 600*a*, a first pull-down circuit module 700*a*, a first pull-up control module 800*a*, a first pull-down control module 900*a* and a second pull-up circuit module 1500*a*. The first pull-up circuit module 600*a*, the first pull-down circuit module 700*a*, the first pull-up control module 800*a* and the first pull-down control module 900*a* in FIG. 16 have circuit strictures similar to that of the first pull-up circuit module 600, the first pull-down circuit module 700, the first pull-up control module 800 and the first pull-down control module 900 in FIG. 12. However, as described previously, it is to be noted that the second control signal Scan_N−2(N−1), Scan_N−2(N) and Scan_N−2(N+1) are equivalent to the start signals S(N−1), S(N) and S(N+1) provided by the respective shift registers, respectively. The operation of the first pull-up circuit module 600*a*, the first pull-down circuit module 700*a*, the first pull-up control module 800*a* and the first pull-down control module 900*a* have been described previously, and no redundant detail is to be given herein.

In addition, the electrical connection between the second pull-up circuit module 1500*a* and the start signal node ST(N) has been described in FIG. 15, and no redundant detail is to be given herein. In FIG. 16, it is to be noted that the voltage of the start signal S(N) provided by the start signal node ST(N) is pulled up to the first operation voltage level VGH through the second pull-up circuit module 1500*a* only when both of the second control signals Scan_N−2(N−1), Scan_N−2(N+1) have a low-voltage level. In addition, as shown in FIG. 12, the voltage of the start signal S(N) provided by the start signal node ST(N) is pulled down to the second operation voltage level VGL when both of the second control node Boot(N) and the clock signal CK1 have a low-voltage level, and the voltage of the start signal S(N) is maintained to the first operation voltage level VGH in the remaining time. Thus, the start signals S(N) generated by the circuits 1200, 1600 in FIGS. 12, 16 have the same waveform. In addition, the voltage level at the start signal node ST(N) in the circuit 1600 is equivalent to the second control signal Scan_N−2(N); thus, the second control signal Scan_N−2(N) generated by the circuit 1600 is pulled down to the second operation voltage level VGL when both of the second control node Boot(N) and the clock signal CK1 have a low-voltage level.

Figure 17A:
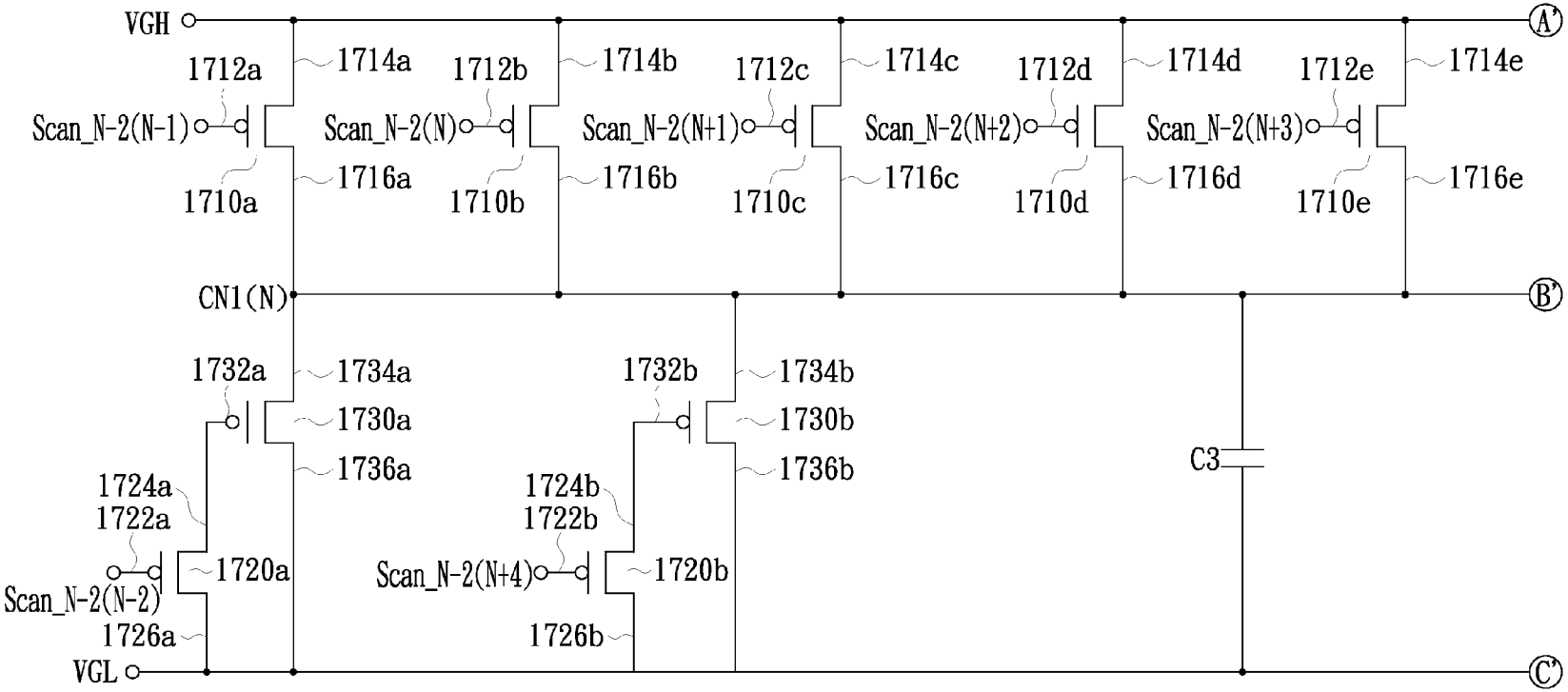
FIGS. 17A, 17B and 17C are circuit views of the first, second and third parts of a light emitting control signal generator in accordance with an embodiment of the present disclosure.
Figure 17B:
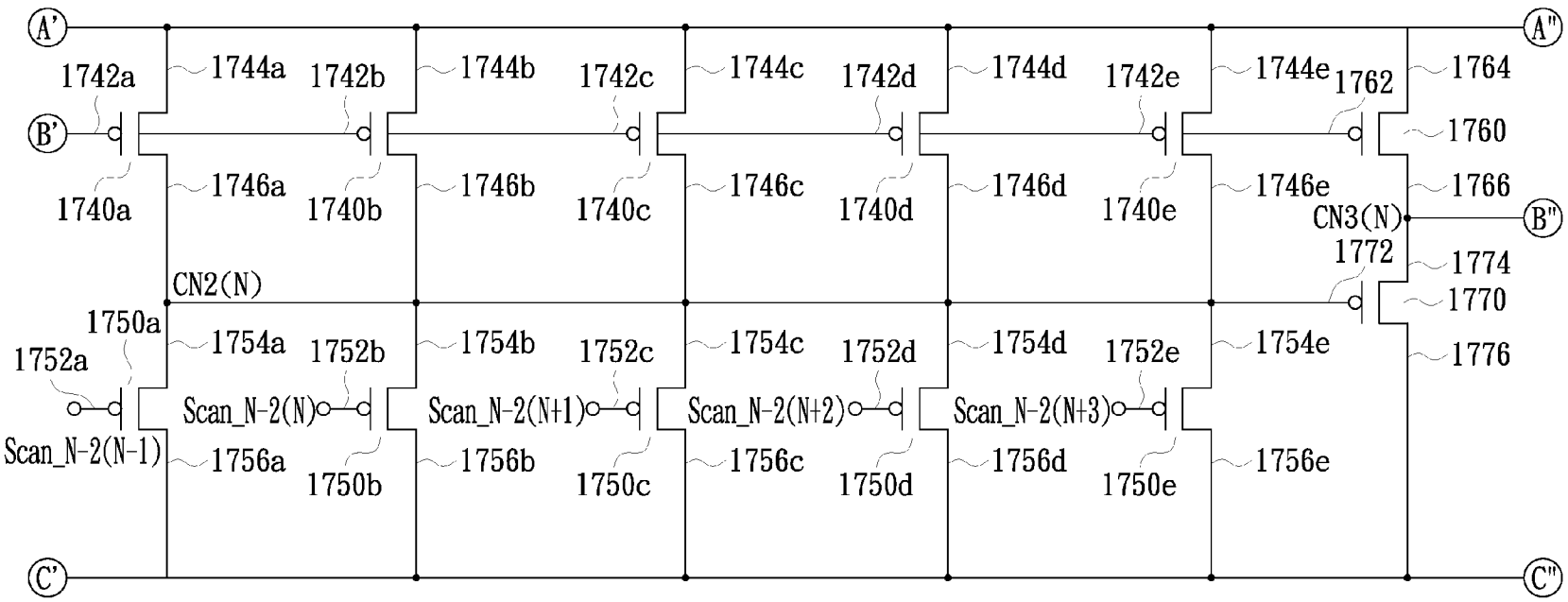
Figure 17C:
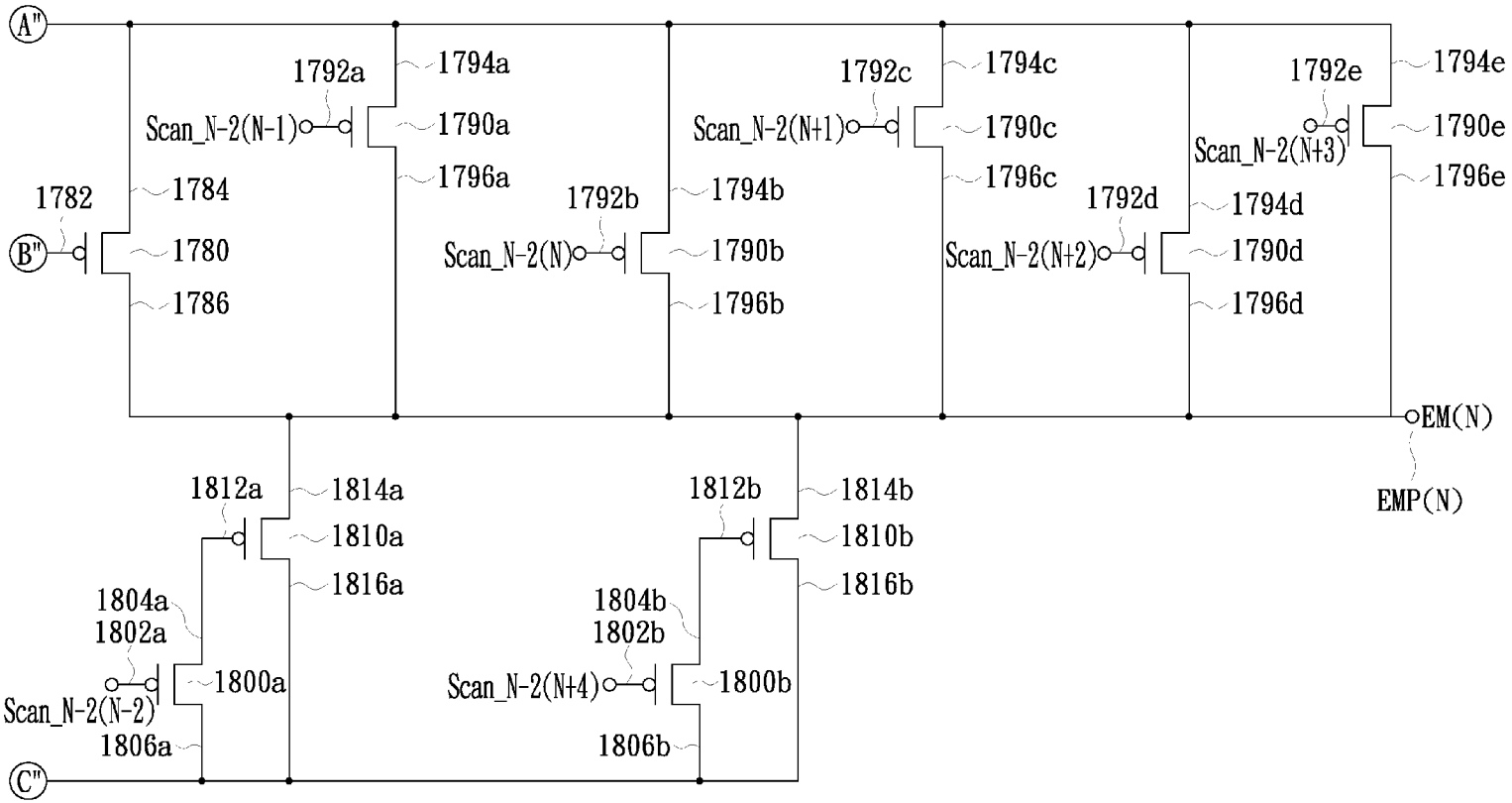

FIGS. 17A, 17B and 17C are circuit views of the first, second and third parts of a light emitting control signal generator in accordance with an embodiment of the present disclosure. As shown in FIGS. 17A, 17B and 17C, the light emitting control signal generator in the present embodiment includes P-type transistors 1710*a*~1710*e*, 1720*a*~1720*b*, 1730*a*~1730*b*, 1740*a*~1740*e*, 1750*a*~1750*e*, 1760, 1770, 1780, 1790*a*~1790*e*, 1800*a*~1800*b* and 1810*a*~1810*b* and a capacitor C3. The Nth-stage light emitting control signal generator EMC (N) herein is took as an example as follow.

Please refer to FIG. 17A, first. The P-type transistor 1710*a* is configured to have its control terminal 1712*a* for receiving the second control signal Scan_N−2(N−1) generated by the gate control signal generator corresponding to the previous-stage (the (N−1)th-stage) shift register, its channel terminal 1714*a* for receiving the first operation voltage level VGH, and its channel terminal 1716*a* electrically coupled to the control node CN1(N). The P-type transistor 1710*b* is configured to have its control terminal 1712*b* for receiving the second control signal Scan_N−2(N) generated by the gate control signal generator corresponding to the present-stage (the Nth-stage) shift register, its channel terminal 1714*b* for receiving the first operation voltage level VGH, and its channel terminal 1716*b* electrically coupled to the control node CN1(N). The P-type transistor 1710*c* is configured to have its control terminal 1712*c* for receiving the second control signal Scan_N−2(N+1) generated by the gate control signal generator corresponding to the next-stage (the (N+1)th-stage) shift register, its channel terminal 1714*c* for receiving the first operation voltage level VGH, and its channel terminal 1716*c* electrically coupled to the control node CN1(N). The P-type transistor 1710*d* is configured to have its control terminal 1712*d* for receiving the second control signal Scan_N−2(N+2) generated by the gate control signal generator corresponding to the next-two-stage (the (N+2)th-stage) shift register, its channel terminal 1714*d* for receiving the first operation voltage level VGH, and its channel terminal 1716*d* electrically coupled to the control node CN1(N). The P-type transistor 1710*e* is configured to have its control terminal 1712*e* for receiving the second control signal Scan_N−2(N+3) generated by the gate control signal generator corresponding to the next-three-stage (the (N+3)th-stage) shift register, its channel terminal 1714*e* for receiving the first operation voltage level VGH, and its channel terminal 1716*e* electrically coupled to the control node CN1(N).

Furthermore, the P-type transistor 1720*a* is configured to have its control terminal 1722*a* for receiving the second control signal Scan_N−2(N−2) generated by the gate control signal generator corresponding to the previous-two-stage (the (N−2)th-stage) shift register and its channel terminal 1726*a* for receiving the second operation voltage level VGL. The P-type transistor 1730*a* is configured to have its control terminal 1732*a* electrically coupled to the channel terminal 1724*a* of the P-type transistor 1720*a*, its channel terminal 1734*a* electrically coupled to the control node CN1(N), and its channel terminal 1736*a* for receiving the second operation voltage level VGL. The P-type transistor 1720*b* is configured to have its control terminal 1722*b* for receiving the second control signal Scan_N−2(N+4) generated by the gate control signal generator corresponding to the next-four-stage (the (N+4)th-stage) shift register and its channel terminal 1726*b* for receiving the second operation voltage level VGL. The P-type transistor 1730*b* is configured to have its control terminal 1732*b* electrically coupled to the channel terminal 1724*b* of the P-type transistor 1720*b*, its channel terminal 1734*b* electrically coupled to the control node CN1(N), and its channel terminal 1736*b* for receiving the second operation voltage level VGL. The capacitor C3 is configured to have its first terminal electrically coupled to the control node CN1(N) and its second terminal for receiving the second operation voltage level VGL.

Next, please refer to FIG. 17B. The P-type transistors 1740*a*, 1740*b*, 1740*c*, 1740*d* and 1740*e* are configured to have their control terminals 1742*a*, 1742*b*, 1742*c*, 1742*d* and 1742*e* electrically coupled to the control node CN1(N) (via the node B'), their channel terminals 1744*a*, 1744*b*, 1744*c*, 1744*d* and 1744*e* for receiving the first operation voltage level VGH (via the node A'), and their channel terminals 1746*a*, 1746*b*, 1746*c*, 1746*d* and 1746*e* electrically coupled to the control node CN2(N), respectively.

Furthermore, the P-type transistor 1750*a* is configured to have its control terminal 1752*a* for receiving the second control signal Scan_N−2(N−1) generated by the gate control signal generator corresponding to the (N−1)th-stage shift register, its channel terminal 1754*a* electrically coupled to the control node CN2(N), and its channel terminal 1756*a* for receiving the second operation voltage level VGL (via the node C'). The P-type transistor 1750*b* is configured to have its control terminal 1752*b* for receiving the second control signal Scan_N−2(N) generated by the gate control signal generator corresponding to the Nth-stage shift register, its channel terminal 1754*b* electrically coupled to the control node CN2(N), and its channel terminal 1756*b* for receiving the second operation voltage level VGL (via the node C'). The P-type transistor 1750*c* is configured to have its control terminal 1752*c* for receiving the second control signal Scan_N−2(N+1) generated by the gate control signal generator corresponding to the (N+1)th-stage shift register, its channel terminal 1754*c* electrically coupled to the control node CN2(N), and its channel terminal 1756*c* for receiving the second operation voltage level VGL (via the node C'). The P-type transistor 1750*d* is configured to have its control terminal 1752*d* for receiving the second control signal Scan_N−2(N+2) generated by the gate control signal generator corresponding to the (N+2)th-stage shift register, its channel terminal 1754*d* electrically coupled to the control node CN2(N), and its channel terminal 1756*d* for receiving the second operation voltage level VGL (via the node C'). The P-type transistor 1750*e* is configured to have its control terminal 1752*e* for receiving the second control signal Scan_N−2(N+3) generated by the gate control signal generator corresponding to the (N+3)th-stage shift register, its channel terminal 1754*e* electrically coupled to the control node CN2(N), and its channel terminal 1756*e* for receiving the second operation voltage level VGL (via the node C').

Further, the P-type transistor 1760 is configured to have its control terminal 1762 electrically coupled to the control node CN1(N) (via the node B'), its channel terminal 1764 for receiving the first operation voltage level VGH, and its channel terminal 1766 electrically coupled to the control node CN3(N). The P-type transistor 1770 is configured to have its control terminal 1772 electrically coupled to the control node CN2(N), its channel terminal 1774 electrically coupled to the control node CN3(N), and its channel terminal 1776 for receiving the second operation voltage level VGL (via the node C').

Next, please refer to FIG. 17C. The P-type transistor 1780 is configured to have its control terminal 1782 electrically coupled to the control node CN3(N) (via the node B"), its channel terminal 1784 for receiving the first operation voltage level VGH (via the nodes A" and A'), and its channel terminal 1786 electrically coupled to the light emitting control signal generating node EMP(N). Furthermore, the P-type transistor 1790*a* is configured to have its control terminal 1792*a* for receiving the second control signal Scan_N−2(N−1); the P-type transistor 1790*b* is configured to have its control terminal 1792*b* for receiving the second control signal Scan_N−2(N); the P-type transistor 1790*c* is configured to have its control terminal 1792*c* for receiving the second control signal Scan_N−2(N+1); the P-type transistor 1790*d* is configured to have its control terminal 1792*d* for receiving the second control signal Scan_N−2(N+2); and the P-type transistor 1790*e* is configured to have its control terminal 1792*e* for receiving the second control signal Scan_N−2(N+3). The P-type transistors 1790*a*~1790*e* are further configured to have their channel terminals 1794*a*~1794*e* for receiving the first operation voltage level VGH (via the nodes A" and A') and their channel terminals 1796*a*~1796*e* electrically coupled to the light emitting control signal generating node EMP(N), respectively.

Further, the P-type transistor 1800*a* is configured to have its control terminal 1802*a* for receiving the second control signal Scan_N−2(N−2) and its channel terminal 1806*a* for receiving the second operation voltage level VGL. The P-type transistor 1810*a* is configured to have its control terminal 1812*a* electrically coupled to the channel terminal 1804*a* of the P-type transistor 1800*a*, its channel terminal 1814*a* electrically coupled to the light emitting control signal generating node EMP(N), and its channel terminal 1816*a* for receiving the second operation voltage level VGL. The P-type transistor 1800*b* is configured to have its control terminal 1802*b* for receiving the second control signal Scan_N−2(N+4) and its channel terminal 1806*b* for receiving the second operation voltage level VGL. The P-type transistor 1810*b* is configured to have its control terminal 1812*b* electrically coupled to the channel terminal 1804*b* of the P-type transistor 1800*b*, its channel terminal 1814*b* electrically coupled to the light emitting control signal generating node EMP(N), and its channel terminal 1816*b* for receiving the second operation voltage level VGL.

In the above circuit, the light emitting control signal EM(N) generated by the light emitting control signal generator EMC(N) is constituted by the voltage level at the light emitting control signal generating node EMP(N). From another view point, the light emitting control signal generator EMC(N) uses the second control signals Scan_N−2(N−2)~Scan_N−2(N+4) to generate the corresponding light emitting control signal EM(N); ant that is why the light emitting control signal EM(N) is electrically coupled to the gate control signal generators GCS2(N−2)~GCS2(N+4), as illustrated in FIG. 14B. As previously described, the second control signal Scan_N−2 actually is same as the start signal S in the same shift register, thus, the second control signals Scan_N−2(N−2)~Scan_N−2(N+4) are substantially same as the start signals S(N−2)~S(N+4) generated by the respective shift registers. Accordingly, the light emitting control signal generator EMC(N) in FIG. 14B can be electrically coupled to the start signal nodes ST(N−2)~ST(N+4) in the shift registers SR(N−2)~SR(N+4), respectively, thereby achieving the same operation object.

Figure 18:
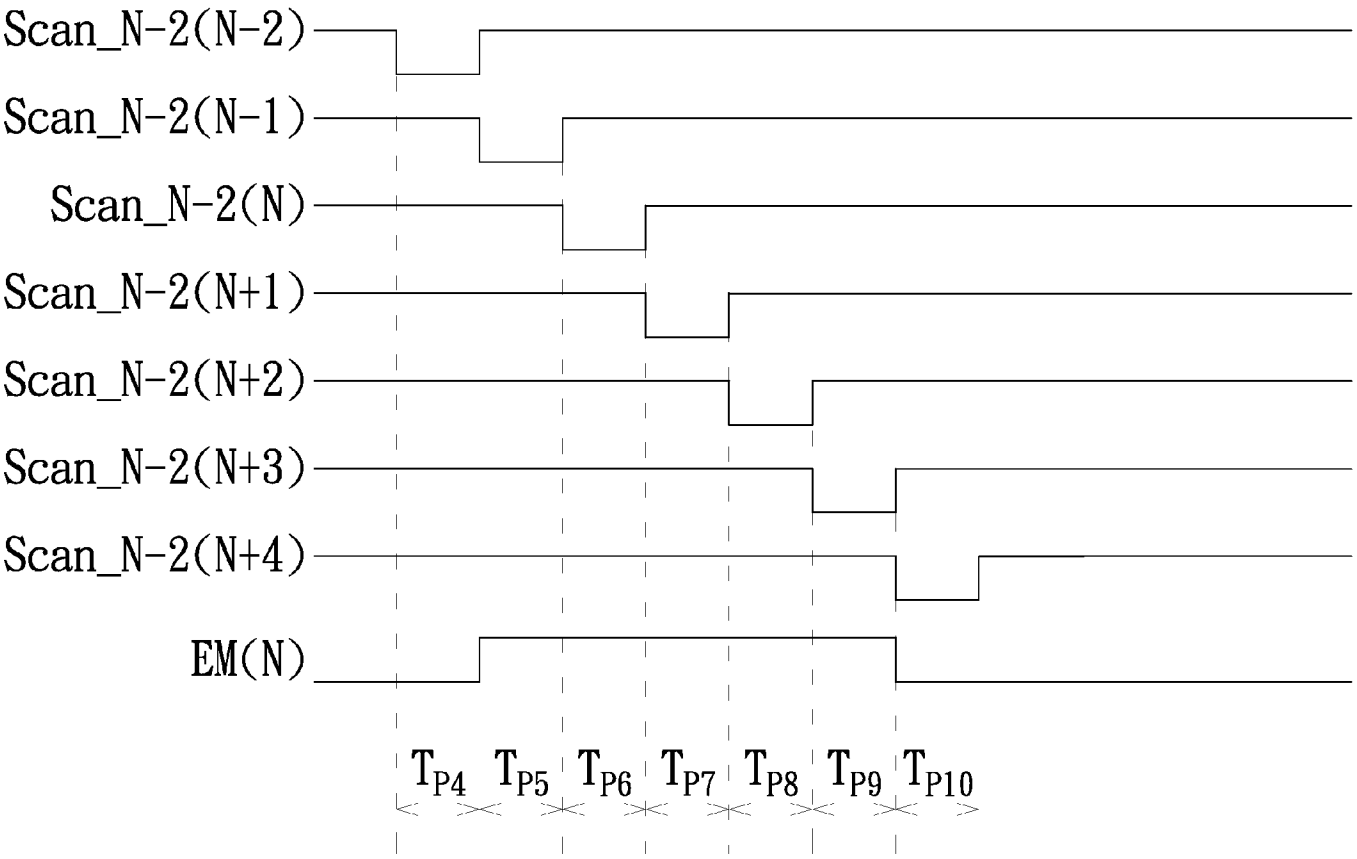
FIG. 18 is an operation timing chart of a light emitting control signal generator in accordance with an embodiment of the present disclosure.

FIG. 18 is an operation timing chart of a light emitting control signal generator in accordance with an embodiment of the present disclosure. Herein the Nth-stage light emitting control signal generator of FIGS. 17A-17C is took as an example. During the operation period $T_{P4}$, the second control signal Scan_N−2(N−2) has a low-voltage level and the second control signals Scan_N−2(N−1)~Scan_N−2(N+4) have a high-voltage level. Thus, the P-type transistor 1720*a* is turned on; the voltage at the control terminal 1732*a* of the P-type transistor 1730*a* is pulled down to close to the second operation voltage level VGL; and the electrical channel between the channel terminals 1734*a*, 1736*a* of the P-type transistor 1730*a* is turned on. Based on the same reason, the electrical channel between the channel terminals 1814*a*, 1816*a* of the P-type transistor 1810*a* is also turned on. In addition, the second control signals Scan_N−2(N−1)~Scan_N−2(N+4) all have a high-voltage level. Thus, the P-type transistors 1710*a*~1710*e*, 1750*a*~1750*e*, 1790*a*~1790*e*, 1720*b*, 1730*b*, 1800*b* and 1810*b* are turned off; the voltage at the control node CN1(N) is maintained to a low-voltage level (about the second operation voltage level VGL); the voltage at the light emitting control signal generating node EMP(N) is maintained to a low-voltage level (about the second operation voltage level VGL). Because being constituted by the voltage level at the light emitting control signal generating node EMP(N), the light emitting control signal EM(N) is maintained to a low-voltage level during the operation period $T_{P4}$.

During the operation period $T_{P5}$, the second control signal Scan_N−2(N−1) has a low-voltage level, the second control signal Scan_N−2(N−2) is converted from a low-voltage level to a high-voltage level, and the second control signals Scan_N−2(N)~Scan_N−2(N+4) are maintained to a high-voltage level. Thus, the P-type transistors 1710*a*, 1750*a* are turned on; the P-type transistors 1730*a*, 1810*a* are turned off; the voltage at the control node CN1(N) is converted to a high-voltage level; and the voltage at the light emitting control signal generating node EMP(N) is pulled up to a high-voltage level (about the first operation voltage level VGH). As a result, the light emitting control signal EM(N) is maintained to a high-voltage level during the operation period $T_{P5}$.

During the operation periods $T_{P6}$~$T_{P9}$, the second control signals Scan_N−2(N)~Scan_N−2(N+3) are sequentially pulled up to a high-voltage level, thus, the P-type transistors 1710*b*~1710*e*, 1750*b*~1750*e* and 1790*b*~1790*e* are sequentially turned on. Accordingly, similar to the reason in the operation period $T_{P5}$, the voltage at the light emitting control signal generating node EMP(N) is pulled up to a high-voltage level (about the first operation voltage level VGH) during the operation periods $T_{P6}$~$T_{P9}$. As a result, the light emitting control signal EM(N) is maintained to a high-voltage level during the operation periods $T_{P6}$~$T_{P9}$.

Then, during the operation period $T_{P10}$, the second control signal Scan_N−2(N+4) has a low-voltage level and the second control signals Scan_N−2(N−2)~Scan_N−2(N+3) all have a high-voltage level. Thus, the P-type transistor 1720*b* is turned on; the voltage at the control terminal 1732*b* of the P-type transistor 1730*b* is pulled down to close to the second operation voltage level VGL; and the electrical channel between the channel terminals 1734*b*, 1736*b* of the P-type transistor 1730*b* is turned on. Based on the same reason, the electrical channel between the channel terminals 1814*b*, 1816*b* of the P-type transistor 1810*b* is also turned on. In addition, the second control signals Scan_N−2(N−2)~Scan_N−2(N+3) all have a high-voltage level. Thus, the P-type transistors 1710*a*~1710*e*, 1750*a*~1750*e*, 1790*a*~1790*e*, 1720*a*, 1730*a*, 1800*a* and 1810*a* are turned off; the voltage at the control node CN1(N) is maintained to a low-voltage level (about the second operation voltage level VGL); the voltage at the light emitting control signal generating node EMP(N) is maintained to a low-voltage level (about the second operation voltage level VGL). As a result, the light emitting control signal EM(N) is maintained to a low-voltage level during the operation period $T_{P10}$.

In summary, the light emitting control signal generator EMC(N) disclosed in the above embodiment can generate a light emitting control signal EM(N) with a time length five times of one cycle of the second control signal.

Figure 19:
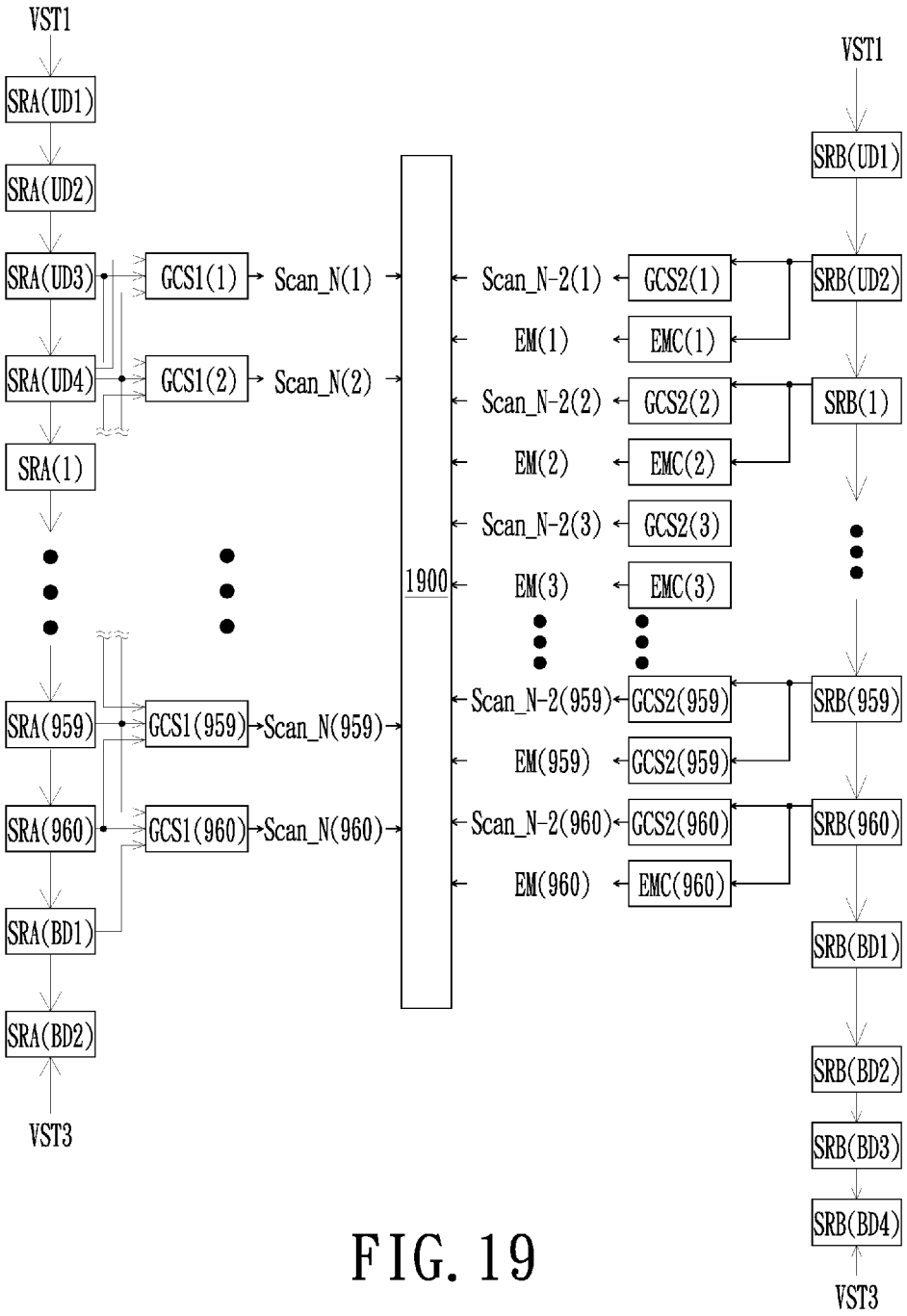
FIG. 19 is a circuit block view of a flat panel display in accordance with another embodiment of the present disclosure.

It is understood that the circuit structures disclosed in the aforementioned embodiments are merely examples, which should not unduly limit the scope of the present disclosure. One of ordinary skill in the art would recognize many variations, alternatives, and modifications. For example, the object of reducing the number of various control signals can be achieved through an adjustment of the dummy shift registers. Referring FIG. 19, which is a circuit block view of a flat panel display in accordance with another embodiment of the present disclosure.

As shown, the display area 1900 is driven by a corporation of the shift register area on the left and the shift register area on the right. The left shift register area includes, from top to bottom, four upper dummy shift registers SRA(UD1)~SRA(UD4), a plurality of shift registers SRA(1)~SRA(960) and two bottom dummy shift register SRA(BD1), SRA(BD2). The left shift register area includes, from top to bottom, two upper dummy shift registers SRB(UD1), SRB(UD2), a plurality of shift registers SRB(1)~SRB(960) and four bottom dummy shift registers SRB(BD1)~SRB(BD4). Through the aforementioned circuit structure, one start signal VST1 can be used for both of the shift register areas disposed on two opposite sides of the display area 1900 when the gate lines are being scanned from top to bottom, and consequentially the number of needed control signal is reduced. Similarly, one start signal VST3 can be used for both of the shift register areas disposed on two opposite sides of the display area 1900 when the gate lines are being scanned from bottom to top. In addition, to employ the aforementioned circuit structure, it is understood that the left shift register area is required to be provided with the first operation voltage level VGH, the second operation voltage level VGL, the clock signal CK1 (including the inverted clock signal) and the enable signal EN1; and the left shift register area is required to be provided with the first operation voltage level VGH, the second operation voltage level VGL and the clock signal CK1 (including the inverted clock signal). Therefore, the number of signal sources needed to be provided to the shift register area is less than ten; and the number of the signal types is up to five only.

Similarly, to facilitate a better understanding of the present disclosure, each gate control signal generator in the right shift register areas is exemplarily illustrated having one electrical channel with the respective shift register only; however, it is to be noted that each gate control signal generator may be electrically coupled to more than one shift register. Similarly, each light emitting control signal generator may be electrically coupled to more than one shift register. In addition, the detailed electrical coupling relationships between one gate control signal generator, light emitting control signal generators and other related circuit components have been described in FIG. 14B.

In addition, preferably, each transistor in various unit or driving circuits in the aforementioned embodiments is integrated into the display panel. In other words, these transistors are formed on a substrate of the display panel together with pixels, data lines and driving lines; and the various units and driving circuits are not formed in the substrate of display panel through a chip bonding manner. Thus, the display panel of the present disclosure is realized by gate driver integrated on array/glass (GOA) circuits. In summary, by dividing the gate control signal generators into two areas in the present disclosure, the control signals Scan_N with higher driving impedances can be driven independently and the control signals Scan_N−1 with lower driving impedances and the light emitting control signals EM can be driven by another group of circuits. In addition, by employing the first gate line driving circuit and the second gate line driving circuit disclosed in the present disclosure, fewer switches are needed, the tolerance range of the manufacturing process offset is effectively enhanced, the abnormal function of circuits and the deterioration of image display caused by the electrical drifts resulted by the manufacturing process errors can be avoided. In addition, through the adjustment of the number of dummy shift register, the number of needed signal is reduced and accordingly the complexity of circuit layout is reduced.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A display panel, comprising:

a display area, comprising a plurality of pixels, each one of the plurality of pixels being configured to determine how to process a data transmitted on a data line according to a first control signal transmitted on a first gate line and a second control signal transmitted on a second gate line and determine when to emit a light according to a light emitting control signal transmitted on a light emitting control line;

a first gate line driving circuit, disposed in a first area outside the display area, the first gate line driving circuit being electrically coupled to the first gate line and configured to provide the first control signal to the first gate line, wherein the first gate line driving circuit comprises:

a plurality of shift registers, the plurality of shift register being sequentially connected in a cascade manner and configured to transmit a start signal from a Nth-stage of the plurality of shift registers to a (N+1)th-stage of the plurality of shift registers; and a plurality of first gate control signal generators, each one of the plurality of first gate control signal generators being electrically coupled to one of the plurality of shift registers and configured to generate the respective first control signal according to an output of the electrically-coupled shift register;

wherein the Nth-stage shift register comprises:

a first pull-up circuit module, configured to receive a first operation voltage level and a start signal provided by a (N−1)th-stage of the plurality of shift registers to the Nth-stage shift register and determine whether to turn on an electrical channel from the first operation voltage level to a first control node or not according to the start signal provided by the (N−1)th-stage shift register and the start signal provided by the Nth-stage shift register;

a first pull-down circuit module, configured to receive a second operation voltage level and a start signal provided by the (N+1)th-stage shift register and determine whether to turn on an electrical channel from the second operation voltage level to the first control node or not according to the start signal provided by the (N+1)th-stage shift register;

a first pull-up control circuit module, electrically coupled to the first control node and configured to receive the first operation voltage level and determine whether to turn on an electrical channel from the first operation voltage level to a second control node and an electrical channel from the first operation voltage level to a start signal node or not according to a voltage level at the first control node; and a first pull-down control circuit module, configured to receive a clock signal, the second operation voltage level and the start signal provided by the (N−1)th-stage shift register and determine whether to transmit the second operation voltage level to the second control node or not according to the start signal provided by the (N−1)th-stage shift register and determine whether to turn on an electrical channel from the clock signal to the start signal node or not according to a voltage level at the second control node, wherein the first pull-down control circuit module comprises:

a first switch, comprising a control terminal, a first channel terminal and a second channel terminal, the first switch being configured to have its control terminal for receiving the start signal provided by the (N−1)th-stage shift register and its first channel terminal electrically coupled to the second control node;

a second switch, comprising a control terminal, a first channel terminal and a second channel terminal, the second switch being configured to have its control terminal for receiving the start signal provided by the (N−1)th-stage shift register, its first channel terminal electrically coupled to the second channel terminal of the first switch, and its second channel terminal for receiving the second operation voltage level;

a third switch, comprising a control terminal, a first channel terminal and a second channel terminal, the third switch being configured to have its control terminal electrically coupled to the second control node and its first channel terminal electrically coupled to the start signal node;

a fourth switch, comprising a control terminal, a first channel terminal and a second channel terminal, the fourth switch being configured to have its control terminal electrically coupled to the second control node, its first channel terminal electrically coupled to the second channel terminal of the third switch, and its second channel terminal for receiving the clock signal; and a capacitor, comprising a first terminal and a second terminal, the capacitor being configured to have its first terminal electrically coupled to the start signal node and its second terminal electrically coupled to the second control node;

wherein the start signal provided by the Nth-stage shift register is constituted by the voltage level at the start single node; and a second gate line driving circuit, disposed in a second area outside the display area, the second gate line driving circuit being electrically coupled to the second gate line and configured to provide the second control signal to the second gate line, the second gate line driving circuit being further electrically coupled to the light emitting control line and further configured to provide the light emitting control signal to the light emitting control line, wherein the first area and the second area are located on different sides of the display area, wherein a minimum time interval, between a first enable period of the first control signal and a second enable period of the second control signal used in a first pixel, is equal to a time length of the first enable period.

2. The display panel according to claim 1, wherein the first pull-up circuit module comprises:

a first switch, comprising a control terminal, a first channel terminal and a second channel terminal, the first switch being configured to have its control terminal for receiving the start signal provided by the (N−1)th-stage shift register, its first channel terminal for receiving the first operation voltage level, and its second channel terminal electrically coupled to the first control node;

a second switch, comprising a control terminal, a first channel terminal and a second channel terminal, the second switch being configured to have its control terminal for receiving the start signal provided by the Nth-stage shift register, its first channel terminal for receiving the first operation voltage level, and its second channel terminal electrically coupled to the first control node; and a third switch, comprising a control terminal, a first channel terminal and a second channel terminal, the third switch being configured to have its control terminal for receiving the start signal provided by the Nth-stage shift register and its first channel terminal for receiving the first operation voltage level.

3. The display panel according to claim 1, wherein the first pull-down circuit module comprises:

a first switch, comprising a control terminal, a first channel terminal and a second channel terminal, the first switch being configured to have its control terminal for receiving the start signal provided by the (N+1)th-stage shift register and its first channel terminal electrically coupled to the first control node;

a second switch, comprising a control terminal, a first channel terminal and a second channel terminal, the second switch being configured to have its control terminal for receiving the start signal provided by the (N+1)th-stage shift register, its first channel terminal electrically coupled to the second channel terminal of the first switch, and its second channel terminal for receiving the second operation voltage level; and a capacitor, comprising a first terminal and a second terminal, the capacitor being configured to have its first terminal electrically coupled to the first control node and its second terminal for receiving the second operation voltage level.

4. The display panel according to claim 1, wherein the first pull-up control circuit module comprises:

a first switch, comprising a control terminal, a first channel terminal and a second channel terminal, the first switch being configured to have its control terminal electrically coupled to the first control node, its first channel terminal for receiving the first operation voltage level, and its second channel terminal electrically coupled to the second control node; and a second switch, comprising a control terminal, a first channel terminal and a second channel terminal, the second switch being configured to have its control terminal electrically coupled to the first control node, its first channel terminal for receiving the first operation voltage level, and its second channel terminal electrically coupled to the start signal node.

5. The display panel according to claim 1, wherein at least one of the plurality of first gate control signal generators comprises:

a second pull-up control circuit module, electrically coupled to the first control node and a gate control signal output node and configured to receive the first operation voltage level and determine whether to turn on an electrical channel from the first operation voltage level to the gate control signal output node or not according to a voltage level at the first control node;

a second pull-down control circuit module, electrically coupled to the start signal node and the gate control signal output node and configured to receive an enable signal and determine whether to turn on an electrical channel from the enable signal to the gate control signal output node or not according to a voltage level at the start signal node; and a second pull-up circuit module, electrically coupled to the gate control signal output node and configured to receive the start signal provided by the (N−1)th-stage shift register, the start signal provided by the (N+1)th-stage shift register and the first operation voltage level and determine whether to turn on an electrical channel from the first operation voltage level to the gate control signal output node or not according to the start signal provided by the (N−1)th-stage shift register and the start signal provided by the (N+1)th-stage shift register, wherein the first control signal provided by the Nth-stage shift register is constituted by the voltage level at the gate control signal output node.

6. The display panel according to claim 5, wherein the second pull-up control circuit module comprises:

a switch, comprising a control terminal, a first channel terminal and a second channel terminal, the switch being configured to have its control terminal electrically coupled to the first control node, its first channel terminal for receiving the first operation voltage level, and its second channel terminal electrically coupled to the gate control signal output node.

7. The display panel according to claim 5, wherein the second pull-down control circuit module comprises:

a switch, comprising a control terminal, a first channel terminal and a second channel terminal, the switch being configured to have its control terminal electrically coupled to the start signal node, its first channel terminal electrically coupled to the gate control signal output node, and its second channel terminal for receiving the enable signal.

8. The display panel according to claim 5, wherein the second pull-up circuit module comprises:

a first switch, comprising a control terminal, a first channel terminal and a second channel terminal, the first switch being configured to have its control terminal for receiving the start signal provided by the (N−1)th-stage shift register, its first channel terminal for receiving the first operation voltage level, and its second channel terminal electrically coupled to the gate control signal output node; and a second switch, comprising a control terminal, a first channel terminal and a second channel terminal, the second switch being configured to have its control terminal for receiving the start signal provided by the (N+1)th-stage shift register, its first channel terminal for receiving the first operation voltage level, and its second channel terminal electrically coupled to the gate control signal output node.

9. The display panel according to claim 1, wherein the second gate line driving circuit comprises:

a plurality of shift registers, the plurality of shift register being sequentially connected in a cascade manner and configured to transmit the start signal from the Nth-stage of the plurality of shift registers to the (N+1)th-stage of the plurality of shift registers;

a plurality of second gate control signal generators, each one of the plurality of second gate control signal generators being electrically coupled to one of the plurality of shift registers and configured to generate the respective second control signal according to an output of the electrically-coupled shift register; and a plurality of light emitting control signal generators, each one of the plurality of the light emitting control signal generators being electrically coupled to a portion of the plurality of shift registers and configured to generate the respective light emitting control signal according to outputs of the electrically-coupled shift registers.

10. The display panel according to claim 9, wherein the Nth-stage shift register of the second gate line driving circuit comprises:

a first pull-up circuit module, configured to receive a first operation voltage level and the start signal provided by the (N−1)th-stage of the plurality of shift registers to the Nth-stage shift register and determine whether to turn on an electrical channel from the first operation voltage level to a first control node or not according to the start signal provided by the (N−1)th-stage shift register and the start signal provided by the Nth-stage shift register;

a first pull-down circuit module, configured to receive a second operation voltage level and the start signal provided by the (N+1)th-stage shift register and determine whether to turn on an electrical channel from the second operation voltage level to the first control node or not according to the start signal provided by the (N+1)th-stage shift register;

a first pull-up control circuit module, electrically coupled to the first control node and configured to receive the first operation voltage level and determine whether to turn on an electrical channel from the first operation voltage level to a second control node and an electrical channel from the first operation voltage level to the start signal node or not according to a voltage level at the first control node; and a first pull-down control circuit module, configured to receive a clock signal, the second operation voltage level and the start signal provided by the (N−1)th-stage shift register and determine whether to transmit the second operation voltage level to the second control node or not according to the start signal provided by the (N−1)th-stage shift register and determine whether to turn on an electrical channel from the clock signal to the start signal node or not according to a voltage level at the second control node, wherein the start signal provided by the Nth-stage shift register is constituted by the voltage level at the start single node.

11. The display panel according to claim 10, wherein the first pull-up circuit module of the second gate line driving circuit comprises:

a first switch, comprising a control terminal, a first channel terminal and a second channel terminal, the first switch being configured to have its control terminal for receiving the start signal provided by the (N−1)th-stage shift register, its first channel terminal for receiving the first operation voltage level, and its second channel terminal electrically coupled to the first control node;

a second switch, comprising a control terminal, a first channel terminal and a second channel terminal, the second switch being configured to have its control terminal for receiving the start signal provided by the Nth-stage shift register, its first channel terminal for receiving the first operation voltage level, and its second channel terminal electrically coupled to the first control node; and a third switch, comprising a control terminal, a first channel terminal and a second channel terminal, the third switch being configured to have its control terminal for receiving the start signal provided by the Nth-stage shift register and its first channel terminal for receiving the first operation voltage level.

12. The display panel according to claim 10, wherein the first pull-down circuit module of the second gate line driving circuit comprises:

a first switch, comprising a control terminal, a first channel terminal and a second channel terminal, the first switch being configured to have its control terminal for receiving the start signal provided by the (N+1)th-stage shift register and its first channel terminal electrically coupled to the first control node;

a second switch, comprising a control terminal, a first channel terminal and a second channel terminal, the second switch being configured to have its control terminal for receiving the start signal provided by the (N+1)th-stage shift register, its first channel terminal electrically coupled to the second channel terminal of the first switch, and its second channel terminal for receiving the second operation voltage level; and a capacitor, comprising a first terminal and a second terminal, the capacitor being configured to have its first terminal electrically coupled to the first control node and its second terminal for receiving the second operation voltage level.

13. The display panel according to claim 10, wherein the first pull-up control circuit module of the second gate line driving circuit comprises:

a first switch, comprising a control terminal, a first channel terminal and a second channel terminal, the first switch being configured to have its control terminal electrically coupled to the first control node, its first channel terminal for receiving the first operation voltage level, and its second channel terminal electrically coupled to the second control node; and a second switch, comprising a control terminal, a first channel terminal and a second channel terminal, the second switch being configured to have its control terminal electrically coupled to the first control node, its first channel terminal for receiving the first operation voltage level, and its second channel terminal electrically coupled to the start signal node.

14. The display panel according to claim 10, wherein the first pull-down control circuit module of the second gate line driving circuit comprises:

a first switch, comprising a control terminal, a first channel terminal and a second channel terminal, the first switch being configured to have its control terminal for receiving the start signal provided by the (N−1)th-stage shift register and its first channel terminal electrically coupled to the second control node;

a second switch, comprising a control terminal, a first channel terminal and a second channel terminal, the second switch being configured to have its control terminal for receiving the start signal provided by the (N−1)th-stage shift register, its first channel terminal electrically coupled to the second channel terminal of the first switch, and its second channel terminal for receiving the second operation voltage level;

a third switch, comprising a control terminal, a first channel terminal and a second channel terminal, the third switch being configured to have its control terminal electrically coupled to the second control node and its first channel terminal electrically coupled to the start signal node;

a fourth switch, comprising a control terminal, a first channel terminal and a second channel terminal, the fourth switch being configured to have its control terminal electrically coupled to the second control node, its first channel terminal electrically coupled to the second channel terminal of the third switch, and its second channel terminal for receiving the clock signal; and a capacitor, comprising a first terminal and a second terminal, the capacitor being configured to have its first terminal electrically coupled to the start signal node and its second terminal electrically coupled to the second control node.

15. The display panel according to claim 10, wherein at least one of the plurality of second gate control signal generators comprises:

a second pull-up circuit module, electrically coupled to the start signal node and configured to receive the start signal provided by the (N−1)th-stage shift register, the start signal provided by the (N+1)th-stage shift register and the first operation voltage level and determine whether to turn on an electrical channel from the first operation voltage level to the start signal node or not according to the start signal provided by the (N−1)th-stage shift register and the start signal provided by the (N+1)th-stage shift register, wherein the second control signal provided by the Nth-stage shift register is constituted by the voltage level at the start signal node.

16. The display panel according to claim 15, wherein the second pull-up circuit module comprises:

a first switch, comprising a control terminal, a first channel terminal and a second channel terminal, the first switch being configured to have its control terminal for receiving the start signal provided by the (N−1)th-stage shift register, its first channel terminal for receiving the first operation voltage level, and its second channel terminal electrically coupled to the start signal node; and a second switch, comprising a control terminal, a first channel terminal and a second channel terminal, the second switch being configured to have its control terminal for receiving the start signal provided by the (N+1)th-stage shift register, its first channel terminal for receiving the first operation voltage level, and its second channel terminal electrically coupled to the start signal node.

17. The display panel according to claim 10, wherein at least one of the plurality of light emitting control signal generators comprises:

a first switch, a second switch, a third switch, a fourth switch and a fifth switch, of which each comprising a control terminal, a first channel terminal and a second channel terminal, the first, second, third, fourth and fifth switches being configured to have their first channel terminals for receiving the first operation voltage level, their second channel terminals electrically coupled to a first control node, and their control terminals for receiving the start signals provided by the (N−1)th-stage, the Nth-stage, the (N+1)th-stage, a (N+2)th-stage and a (N+3)th-stage shift registers, respectively, wherein the (N+2)th-stage shift register is a shift register one stage after the (N+1)th-stage shift register, and the (N+3)th-stage shift register is a shift register one stage after the (N+2)th-stage shift register;

a sixth switch, comprising a control terminal, a first channel terminal and a second channel terminal, the sixth switch being configured to have its control terminal for receiving a start signal provided by a (N−2)th-stage shift register and its second channel terminal for receiving the second operation voltage level, wherein the (N−2)th-stage shift register is a shift register one stage before the (N−1)th-stage shift register;

a seventh switch, comprising a control terminal, a first channel terminal and a second channel terminal, the seventh switch being configured to have its control terminal electrically coupled to the first channel terminal of the sixth switch, its first channel terminal electrically coupled to the first control node, and it second channel terminal for receiving the second operation voltage level;

an eighth switch, comprising a control terminal, a first channel terminal and a second channel terminal, the eighth switch being configured to have its control terminal for receiving a start signal provided by a (N+4)th-stage of the plurality of shift registers and its second channel terminal for receiving the second operation voltage level, wherein the (N+4)th-stage shift register is a shift register next stage to the (N+3)th-stage shift register;

a ninth switch, comprising a control terminal, a first channel terminal and a second channel terminal, the ninth switch being configured to have its control terminal electrically coupled to the first channel terminal of the eighth transistor, its first channel terminal electrically coupled to the first control node, and its second channel terminal for receiving the second operation voltage level;

a capacitor, comprising a first terminal and a second terminal, the capacitor being configured to have its first terminal electrically coupled to the first control node and its second terminal for receiving the second operation voltage level;

a tenth switch, an eleventh switch, a twelfth switch, a thirteenth switch and a fourteenth switch, of which each comprising a control terminal, a first channel terminal and a second channel terminal, the tenth, eleventh, twelfth, thirteenth and fourteenth switches being configured to have their control terminals electrically coupled to the first control node, their first channel terminals for receiving the first operation voltage level, and their second channel terminals electrically coupled to a second control node;

a fifteenth switch, a sixteenth switch, a seventeenth switch, an eighteenth switch and a nineteenth switch, of which each comprising a control terminal, a first channel terminal and a second channel terminal, the fifteenth, sixteenth, seventeenth, eighteenth and nineteenth switches being configured to have their first channel terminals electrically coupled to the second control node, their second channel terminals for receiving the second operation voltage level, and their control terminals for receiving the start signals provided by the (N−1)th-stage, the Nth-stage, the (N+1)th-stage, the (N+2)th-stage and the (N+3)th-stage shift registers, respectively;

a twentieth switch, comprising a control terminal, a first channel terminal and a second channel terminal, the twentieth switch being configured to have its control terminal electrically coupled to the first control node, its first channel terminal for receiving the first operation voltage level, and its second channel terminal electrically coupled to a third control node;

a twenty-first switch, comprising a control terminal, a first channel terminal and a second channel terminal, the twenty-first switch being configured to have its control terminal electrically coupled to the second control node, its first channel terminal electrically coupled to the third control node, and its second channel terminal for receiving the second operation voltage level;

a twenty-second switch, comprising a control terminal, a first channel terminal and a second channel terminal, the twenty-second switch being configured to have its control terminal electrically coupled to the third control node, its first channel terminal for receiving the first operation voltage level, and its second channel terminal electrically coupled to a light emitting control signal generating node, wherein the light emitting control signal is constituted by a voltage level at the light emitting control signal generating node;

a twenty-third switch, a twenty-fourth switch, a twenty-fifth switch, a twenty-sixth switch and a twenty-seventh switch, of which each comprising a control terminal, a first channel terminal and a second channel terminal, the twenty-third, twenty-fourth, twenty-fifth, twenty-sixth and twenty-seventh switches being configured to have their first channel terminals for receiving the first operation voltage level, their second channel terminals electrically coupled to the light emitting control signal generating node, and their control terminals for receiving the start signals provided by the (N−1)th-stage, the Nth-stage, the (N+1)th-stage, the (N+2)th-stage and the (N+3)th-stage shift registers, respectively;

a twenty-eighth switch, comprising a control terminal, a first channel terminal and a second channel terminal, the twenty-eighth switch being configured to have its control terminal for receiving the start signal provided by the (N−2)th-stage shift register and its second channel terminal for receiving the second operation voltage level;

a twenty-ninth switch, comprising a control terminal, a first channel terminal and a second channel terminal, the twenty-ninth switch being configured to have its control terminal electrically coupled to the first channel terminal of the twenty-eighth switch, its first channel terminal electrically coupled to the light emitting control signal generating node, and its second channel terminal for receiving the second operation voltage level;

a thirtieth switch, comprising a control terminal, a first channel terminal and a second channel terminal, the thirtieth switch being configured to have its control terminal for receiving the start signal provided by the (N+4)th-stage shift register and its second channel terminal for receiving the second operation voltage level; and a thirty-first switch, comprising a control terminal, a first channel terminal and a second channel terminal, the thirty-first switch being configured to have its control terminal electrically coupled to the first channel terminal of the thirtieth switch, its first channel terminal electrically coupled to the light emitting control signal generating node, and its second channel terminal for receiving the second operation voltage level.

* * * * *